United States Patent [19]

Wada et al.

[11] Patent Number: 4,595,065

[45] Date of Patent: Jun. 17, 1986

[54] SHAFT DRILLING RIG

[75] Inventors: Masami Wada, Chiyodamura; Shuichi Ajiro, Tsuchiura, both of Japan

[73] Assignee: Hitachi Construction Machinery Co., Ltd., Tokyo, Japan

[21] Appl. No.: 567,847

[22] PCT Filed: May 23, 1983

[86] PCT No.: PCT/JP83/00156

§ 371 Date: Dec. 14, 1983

§ 102(e) Date: Dec. 14, 1983

[87] PCT Pub. No.: WO84/04778

PCT Pub. Date: Dec. 6, 1984

[51] Int. Cl.[4] ..... E21B 19/20

[52] U.S. Cl. ..... 175/85

[58] Field of Search ..... 175/85, 52, 161; 166/77.5, 85, 377, 378; 182/114; 211/60

[56] References Cited

U.S. PATENT DOCUMENTS

| | | | |
|---|---|---|---|
| 3,446,284 | 5/1969 | Dyer et al. | 175/85 |
| 3,650,339 | 3/1972 | Selfe et al. | 175/85 |
| 3,741,322 | 6/1973 | Wolters | 175/52 |
| 3,902,561 | 9/1975 | Friberg et al. | 175/52 |
| 3,961,673 | 6/1976 | Wolters et al. | 175/52 |
| 3,994,350 | 11/1976 | Smith et al. | 175/85 |
| 4,421,179 | 12/1983 | Boyadjieff | 175/85 X |

FOREIGN PATENT DOCUMENTS 49902 4/1977 Japan .

*Primary Examiner*—Stephen J. Novosad
*Assistant Examiner*—Thuy M. Bui
*Attorney, Agent, or Firm*—Wenderoth, Lind & Ponack

[57] ABSTRACT

A shaft drilling rig with which a shaft is drilled into the earth with a turning force and thrust of drilling imparted to at least the drill bit of a drill string, down to a predetermined depth, and then a new drill string component is added to the drill string, for further drilling.

The subject of the present invention lies in enabling the work of adding a new drill string component to the drill string safely and in a reduced time.

To solve the above problem, the shaft drilling rig according to the present invention comprises a means of receiving an additional drill string component at least at the bottom end thereof, means of supporting said receiving means so as to be stably movable between a position where a drill string component is to be added and a parking position, and a means of holding the additional drill string component.

15 Claims, 30 Drawing Figures

SHAFT DRILLING RIG

BACKGROUND OF THE INVENTION (A) Field of the Invention

The present invention relates to a shaft drilling rig, and more particularly to a shaft drilling machine with which a force of rotary drilling and thrust are imparted to at least a drill bit of a drill string to drill a shaft, slush produced due to the drilling is drained together with soil and sand by forward or reverse circulation, and after having drilled the earth to an predetermined depth, a axial portion of the drill string is disconnected and a new sectional drill pipe member is added to the drill string, for further boring the earth.

The shaft referred to herein includes a vertical and inclined ones drilled in the earth.

Also, the shaft drilling rig referred to herein is used for drilling directly a shaft in the earth by the drill string as well as for drilling a shaft inside a steel pipe previously driven into the earth by a pile driver in order to prevent the hole wall from collapsing and also to guide the stabilizer of the drill string.

Said drill string includes two types: One is such that a turning force of drilling and thrust are given to the almost the whole drill string in order to drill the earth, and the other is such that a turning force of drilling and thrust are imparted to only the drill bit for such drilling. Generally, the former type of drill string comprises a swivel joint, kelly bar formed non-cylindrical or square for enabling the transmission of the turning force from a turning drive for the drill string and the axial movement of the drill string, a plurality of drill pipes to be prepared according to the depth of a shaft to be drilled, a stabilizer as a guide member for steady rest of the drill string, drill collar to impart a weight to the drill string, and a drill bit, which are appropriately coupled together. On the other hand, the latter type of drill string which provides for a drilling motion with a turning force of drilling and thrust given to only the drill bit, is generally composed of a plurality of drill pipes to be prepared according to the depth of a shaft to be drilled, stabilizer, drill bit, and means for imparting the turning force of drilling and thrust to the drill bit, which are also appropriately coupled together, and further it is provided, depending upon the solidity of the ground, with a drill collar or gripper which accomodates a reaction to the thrust of the drill string. These members will be referred to as "components of the drill string or drill string components" anywhere in the subsequent text of this specification. Among the above drill string components, tubular ones are so formed as to have a nearly the same inside diameter for the purpose that fluid or slush produced due to the drilling should be smoothly passed therethrough.

The above-mentioned forward circulation method drilling is generally such that a circulating water is fed by a mud water pump into a pipe laid inside or along the drill string, the mud water discharged from below the drill bit to the bottom of the drill hole (shaft) is circulated through between the outer circumferential surface of the drill string and drill hole (shaft) to outside of the drill hole (shaft), and the mud water thus running is utilized to evacuate the sand and water drilled by the drill bit to outside of the drill hole (shaft) while further drilling the earth. On the other hand, the drilling of reverse circulation method is generally such that the slush consisting of mud water is lifted and discharged through the drill string while further drilling the earth. The embodiments of the present invention will be described later with reference to this drilling of reverse circulation method by way of example. However, it will be apparent to those skilled in the art that the shaft drilling rig according to the present invention can be applied to both the forward and reverse circulation methods.

Also the present invention can be applied to a shaft drilling rig of such as type that drill string is supported on frames installed on a leader in order to drill a vertical shaft or inclined one, and to a shaft drilling rig dedicated to drilling of only a vertical shaft and in which the drill string is supported on a crawler or stationary crane, or on a tower, thereby drilling such a shaft.

(B) Description of the Prior Art

Various shaft drilling rigs have been proposed heretofore in the field of art to which the present invention belongs. Among them, an inclined shaft drilling rig taken by way of example will be described with reference to FIG. 1.

As seen from FIG. 1, the prior-art inclined shaft drilling rig comprises a stand 1 which has tiltably installed at the front end thereof a leader 2 by means of a pin 3.

Said leader 2 has a tilt angle adjusted by a tilting means (not shown) and is supported at a tilt angle thus adjusted. The leader 2 has fixed at the top thereof an upper frame 4 for a first frame, and is provided at the front thereof in the direction of width with at least two parallel guide rails 5 which are vertically elongated.

Said leader 2 has disposed at the front thereof a first frame 6 at the upper side and a second frame 14 at the lower side.

Said first frame 6 is so mounted as to be movable vertically along the guide rail 5 by means of a guide member 7 such as rollers. The first frame 6 is suspended from a suspension system, and supports a drill string 16 which will be described in further detail later, and a thrust jack 29 for the drill string 16.

The suspension for said first frame 6 is composed of sheaves 8 and 9 installed on the upper frame 4, hanging block 10, wire rope 11 unwound from a winch (not shown) located on the stand 1 and routed over said sheaves 8 and 9 and hanging block 10, and a wire rope 13 connecting a hanging bracket 12 provided on the top of the first frame 6 with the hanging block 10. This hanging system is so arranged that as the winch is driven, said first frame 6 is adjustable to a desired position as moved vertically along the guide rails 5 on the leader 2.

Said second frame 14 is so mounted as to be movable vertically along the guide rails 5, and supported by a fixing seat 15 provided at the front of the leader 2. Further, this second frame 14 is provided with a holder 30 for the drill string which will be further described later.

Said drill string 16 consists, from the top toward the bottom end, of an upper swivel joint 17 having an albow 17*a* for connection of a delivery hose, guide pipe 18, lower swivel joint 19, drill pipe 20, stabilizer 21, joint pipe 22, drill collar 23, stabilizer 24, and a drill bit 25, in this order, which all are connected to each other. The guide pipe 18 of the drill string 16 is connected to a rotary drive unit 27 and also so supported as to be movable vertically by a guide 26 located at the bottom end of the first frame 6.

The rotary drive unit 27 for said drill string 16 is so mounted on a seat 28 slidably provided within the first frame 6, as to supply the drill string 16 with a turning force for drilling through the guide pipe 18.

Only one thrust jack 29 for said drill string is shown in the drawing for the simplicity of illustration, but in reality, two parallelly disposed on opposite sides of the drill string 16 and also assembled to the upper half of said first frame 6. The thrust jack 29 is coupled at the moving side thereof with said seat 28 through which it will impart a turning force for drilling to the drill string 16.

Said holder 30 for the drill string is located under the second frame 14. At the time of drilling, this holder 30 is parked in a position away from the location of the drill string 16; when a new drill pipe 20′ is added to the drill string 16, the holder 30 is moved to the working position of the drill string 16 so as to temporarily hold the lower half of the drill string 16 disconnected from the drive system.

Here, how an inclined shaft is drilled by the prior-art inclined shaft drilling rig along inside a steel pipe driven in the earth previously by a pile driver (not shown) will be explained along with how to add a drill string component, for example, a drill pipe, to the drill string, with reference to FIGS. 1 to 4.

First, in order to drill an inclined shaft, the leader 2 is tilted correspondingly to a tilt angle $\alpha$ of the steel pipe 151 previously driven into the earth 150, and the leader 2 is fixed as shown in FIG. 1. Then, the rotary drive unit 27 for the drill string is started to impart a turning force for drilling to the drill string 16. In case of this prior-art inclined shaft drilling rig, the thrust jack 29 is contracted to give a thrust of drilling to the drill string 16. Thus, the drill string 16 is driven down inside the steel pipe 151 as guided by the stabilizers 21 and 24, thereby drilling an inclined shaft 152. During this drilling, the drill slush is lifted up through the inside of the drill string 16 and discharged through the elbow 17*a* connected to the swivel joint 17. When the thrust jack is contracted and the first frame 6 is lowered, both over a stroke equal to the length of one drill pipe 20, the rotary drive unit 27 is stopped and here a new drill pipe 20′ is added to the drill string 16.

In order to add the new drill pipe 20′ to the drill string 16, the holder 30 for the drill string 16 is moved to the working position of the latter, so as to hold the drill string. Then, as shown in FIG. 2, the drill string 16 is disconnected at an axial part thereof while the thrust jack 29 is extended, thereby defining between the upper and lower halves of the drill string 16 a space required for the work of adding the new drill pipe 20′ to the drill string.

Next, also as seen in FIG. 2, the additional drill pipe 20′ is hoisted by a wire rope 32 suspended from a hoisting block 31 with the new drill pipe 20′ tilted to an angle equal to the tilt angle $\alpha$ of the drill string disconnected as described above. Then, the top-end flange 20′*a* of the additional drill pipe 20′ is matched with the bottom-end flange 16*a* of the upper half, as disconnected, of the drill string 16, as illustrated in FIG. 3. The flanges are connected to each other by bolts (not shown). Here, the wire rope 32 is removed from the drill pipe 20′ and the hoisting block 31 is returned to the initial position.

The thrust jack 29 is contracted and the upper half of the drill string 16 to which the new drill pipe 20′ has been added, is lowered and the bottom-end flange 20′*b* of the drill pipe 20′ is matched with the top-end flange 16*b* of the lower half of the drill string 16 as shown in FIG. 4. These flanges are connected to each other by bolts (not shown).

Then, the holder 30 for the drill string 16 is so operated as to release the drill string. Thereafter, the holder 30 is parked at a position away from the location of the drill string 16, and the drill string 16 is supplied again with a turning force and thrust, for drilling, thereby further drilling the earth.

It should be noted that the drill collar 23 is added to the drill string 16 in the procedure having been described above, depending on the rigidity of the earth to be drilled.

With the prior-art inclined shaft drilling rig, however, after an additional drill string component such as drill pipe 20′ is carried and hoisted in the air to a location of connection, workers have to manually guide and align the drill string component while it is suspended in the air, to the bottom-end flange 16*a* of the drill string 16. Therefore, the time of adding any drill string component to the drill string, the workers must support the weight of the component. If the component is very heavy such as the drill collar, considerable labor is required. In this respect, the prior-art inclined shaft drilling rig is not stable in many operations and the work of adding any drill string component is done with a danger. Also, it takes a long time to additionally join a component to the drill string safely and securely. Furthermore, when the drill string 16 is disconnected at an axial part thereof, the upper half of the drill string 16 may possibly turn due to its own weight. Also, immediately after the drill string is disconnected, the first frame 6 may possibly be hoisted up or swing laterally depending upon the tension of the wire rope 11 on the hanging block 10. In these respects, the work of disconnecting the drill string component is accompanied by a very great danger.

Also in case of the prior-art shaft drilling rig, the work of additionally joining a component to the drill string is dangerous and takes a much time since the additional component is joined to the drill string while the component is being suspended in the air by a hanging block and wire rope.

SUMMARY OF THE INVENTION

The present invention has a primary object to overcome the above-mentioned drawbacks of the prior-art by providing a shaft drilling rig which permits additionally joining a drill string component to the drill string very safely, securely and in a reduced time.

Another object of the present invention is to provide a shaft drilling rig which permits securely holding, at time of adding a drill string component to the drill string, the component even if it differs in outside shape from the drill string, by supporting it at the bore thereof.

Yet another object of the present invention is to provide a shaft drilling rig which permits easily aligning the connector or flange of an additional drill string component to the counterpart of a drill string for drilling of an inclined shaft.

Still another object of the present invention is to provide a shaft drilling rig in which a frame in which a drill string and accessory members thereof are mounted is divided into two sections which are at the upper and lower sides, respectively, of a leader at the front thereof so that functions of the frame are shared by these two sections, whereby the frame can be compact and lightweight.

Still yet another object of the present invention is to provide a shaft drilling rig in which a second frame having an adjoining jig and a holder for supporting a lower half of the drill string, disconnected at the time of adding a drill string component to the drill string, can be moved vertically along the leader and easily fixed to a selected position.

A further object of the present invention is to provide a shaft drilling rig permitting to minimize the turn-down of the upper half of the drill string, due to its own weight, when disconnected at an axial part thereof, for addition of a drill string component.

A still further object of the present invention is to provide a shaft drilling rig with which after adjoining an additional drill string component to the drill string at the upper half thereof, the added drill component can be adjoined to the lower half of the drill string by the workers standing at ease.

A yet further object of the present invention is to provide a shaft drilling rig provided with a means capable of holding, when adding a new drill string component to the drill string, any of the components of the lower half of the drill string irrespectively of the diameter of the components.

The foregoing and other objects of the present invention can be attained as follows:

According to an aspect of the present invention, a shaft drilling rig with which a shaft is drilled into the earth with a turning force and thrust for drilling imparted to at least the drill bit of drill string down to a predetermined depth and then a drill string component is added to the drill string, may be provided with a means of receiving the additional drill string component at least at the bottom end thereof, means for supporting said receiving means so as to be stably movable between a position where a drill string component is to be added and a parking position, and a means for holding the additional drill string component. The additional drill string component is supported at the bottom end thereof by said receiving means so that it can be adjoined to the drill string held by the holding means; therefore, it is not necessary to move the additional drill string component as hoisted in the air and to position it while being hoisted. Thus, the dangers in the work of adding the drill string component can all be eliminated. With the shaft drilling rig according to the present invention, an additional drill string component can be adjoined to the drill string with a high safety and in a considerably reduced time.

According to another aspect of the present invention, said receiving means can be composed of a seat for receiving an additional drill string component at the bottom end thereof, and a standing pin provided on the receiving seat, said standing pin being so arranged as to be guidable along the bore of said additional drill string component. Thus, each of various drill string components of which bores are formed nearly identical but have different outside shapes from each other can be securely received, supported and adjoined to the drill string.

According to yet another aspect of the present invention, said receiving means may be provided with a plurality of receivers each having at the inner end thereof a holder capable of supporting as positioned an additional drill string component, and which is additionally provided with a means for selectively switching between a posture in which said additional drill string component can be supported and that in which said component can be pulled down. Thus, an additional drill string component is pulled down toward the top-end flange of the drill string so that the bottom-end flange of said component can be rapidly abutted to the top-end flange of the drill string.

According to still another aspect of the present invention, said receiving means may be provided with a tilting means for aligning the flange of an additional drill string component to that of the drill string. Hereby, in case of an inclined shaft drill string, even if the drill string is turned down due to its weight, the flange of an additional drill string component can be easily aligned with that of the drill string.

According to an important aspect of the present invention, the shaft drilling rig can be comprised of a first and second frames installed to an upper and lower sides, at the front, of the leader supported on the stand, guide rails located above said second frame and which support a receiving means so as to be stably movable between a position where an additional drill string component is adjoined to the drill string and a parking position, said receiving means mounted on said guide rails and which permits to receive the additional drill string component at least at the bottom end thereof, means coupled with said first frame and which holds the drill string, as disconnected, at the upper half thereof, and another means provided below said second frame and which holds the drill string as disconnected. According to the present invention, a frame where various members are installed is divided into two frame sections, first and second, in order that the functions of frame are shared by such two frame sections, whereby it is possible to reduce the dimensions and weight of the frame as a whole.

According to still yet another aspect of the present invention, said second frame may be so arranged that the position thereof is adjustable along the leader by means of a mechanism for coupling between a plurality of pin holes formed in the leader and said second frame itself and set pins which are to be inserted into the pin holes from outside of the second frame. Thus, in case a shaft is drilled inside a steel pipe previously driven into the earth by, for example, a pile driver, even if the length projecting from the ground surface of the steel pipe does not just meet the position of the second frame, the position of the latter can be adjusted and simply fixed at the adjusted position.

According to a further aspect of the present invention, said first frame may be provided each at least at the top and bottom thereof with a guide unit for the drill string. Thus, the upper half of the drill string is supported by at least two guide units located away from each other. Therefore, in case of an inclined shaft drill string, it is possible to minimize considerably the turn-down of the upper half of the drill string as disconnected, due to its own weight.

According to a still further aspect of the present invention, said second frame can have provided at the top thereof guide rails as said supporting means, below which a platform is installed, and a lower point where addition of a new drill string component is done can be set between the platform and guide rails. Thus, the work of adding a new drill string component to the drill string can be done very easily by the workers standing at ease.

According to a yet further aspect of the present invention, said means of holding the lower half of the drill string as disconnected may be so arranged as to hold both drill string components of small and large outside diameters. Thus, a single holding means can be used to securely hold any drill string component whether the latter is a drill pipe of which the outside diameter is small or a drill collar whose outside diameter is large.

BRIEF DESCRIPTION OF THE DRAWINGS

FIGS. 5 to 23 shows together a first embodment of the present invention applied to an inclined shaft drilling rig, of which FIG. 5 is a side elevation of the inclined shaft drilling rig in operating position, with portions broken away;

FIG. 6 is a side elevation showing on an enlarged scale and with portions broken away the installation of a part of the leader, first and second frames mounted on the leader, various members accessory to the first and second frames, and a portion of the drill string extending between the first and second frames;

FIGS. 7 and 8 are cross-sectional plan views on an larger scale, respectively, taken along lines A—A and B—B of FIG. 5 and viewed from the direction of the arrow, showing in detail the rotary drive for the drill string and the guide mechanism located below the drive;

FIG. 9 is also a cross-sectional plan view on a larger scale taken along line C—C of FIG. 5 and viewed from the direction of the arrow;

FIGS. 10 and 11 are longitudinal-sectional views, respectively, taken along lines D—D and E—E of FIG. 9 and viewed from the direction of arrow, these FIGS. 9 to 11 showing in detail together the support means for the lower half section of the drill string;

FIG. 12 is a cross-sectional plan view taken along line F—F and viewed from the direction of the arrow, showing the installation of the leader, second frame, joining jig as receiver of an additional sectional drill pipe member.

FIG. 13 is a plan view on a larger scale of the joining jig;

FIGS. 14 and 15 are longitudinal-sectional views, respectively, taken along lines G—G and H—H of FIG. 13 and viewed from the direction of the arrow;

FIG. 16 is also a longitudinal-sectional view taken along line I—I and viewed from the direction of the arrow, these FIGS. 13 to 16 showing in detail the joining jig and members accessory to the jig;

FIGS. 17 to 23 are explanatory drawings, respectively, of the processes of adding sectional drill pipe members to the drill string;

FIGS. 25 to 30 show together a third embodiment of the present invention applied to a shaft drilling rig; of which FIG. 25 is a side elevation of the shaft drilling rig in operating position, with portions broken away;

FIGS. 26 to 29 show together the joining jig as receiver for additional drill pipe members;

FIG. 26 being a plan view;

FIGS. 27, 28 and 29 being sectional views taken along lines J—J, K—K and L—L, respectively and viewed from the direction of arrow, of FIG. 26; and FIG. 30 is a longitudinal-sectional, side elevation of the joining jig in operating position.

DETAILED DESCRIPTION OF THE PREFERRED EMBODIMENTS

The preferred embodiments of the present invention will be described in the following with reference to the drawings.

Figure 1:
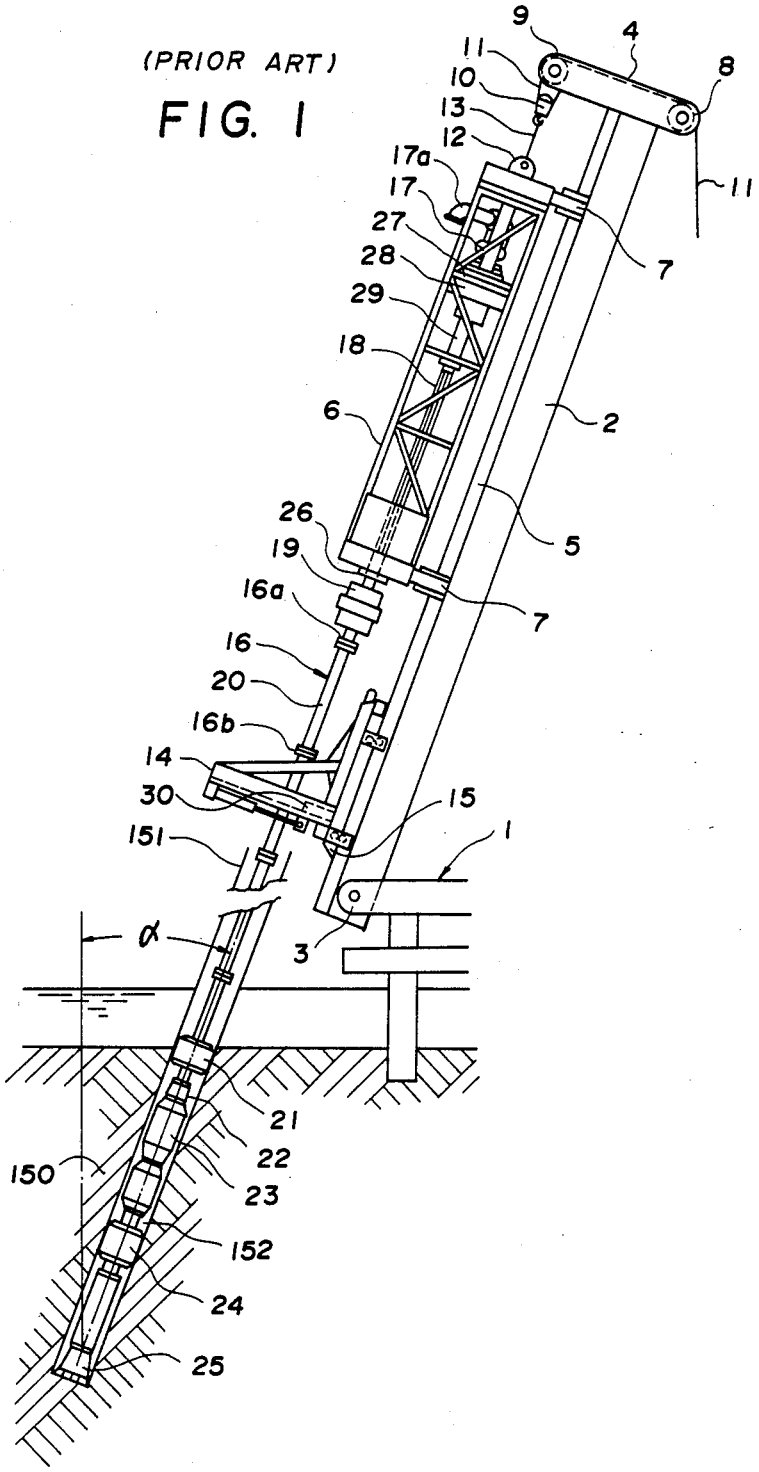
(PRIOR ART) FIG. 1
FIG. 1 is a side elevation of a prior-art inclined shaft drilling rig with portions broken away.
Figure 2:
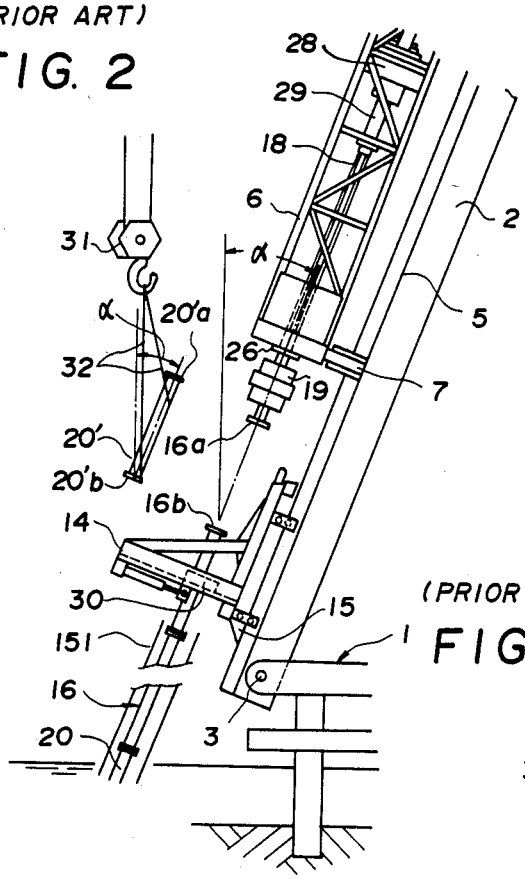
(PRIOR ART) FIG. 2
FIGS. 2, 3 and 4 are explanatory drawings, respectively, of the processes of adding sectional drill pipe members to the drill string.
Figure 3:
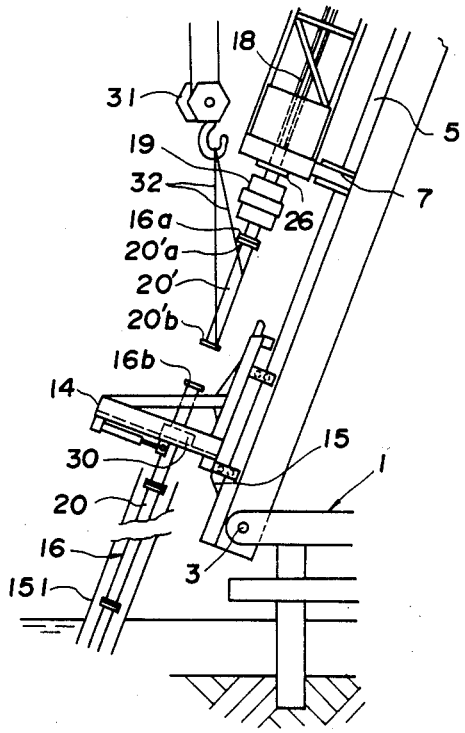
(PRIOR ART) FIG. 3
Figure 4:
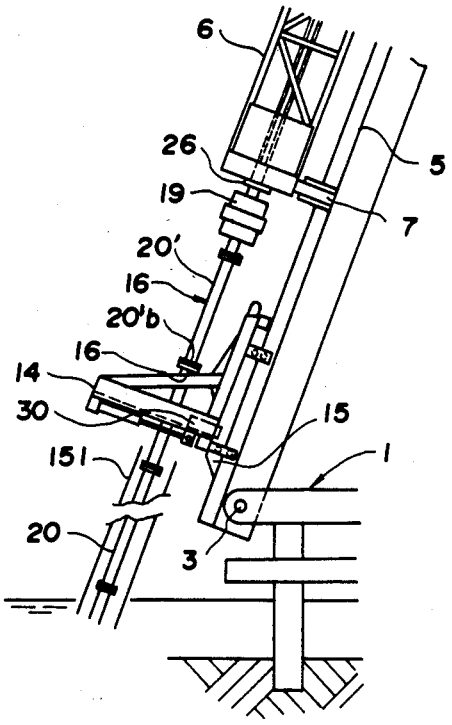
(PRIOR ART) FIG. 4
Figure 5:
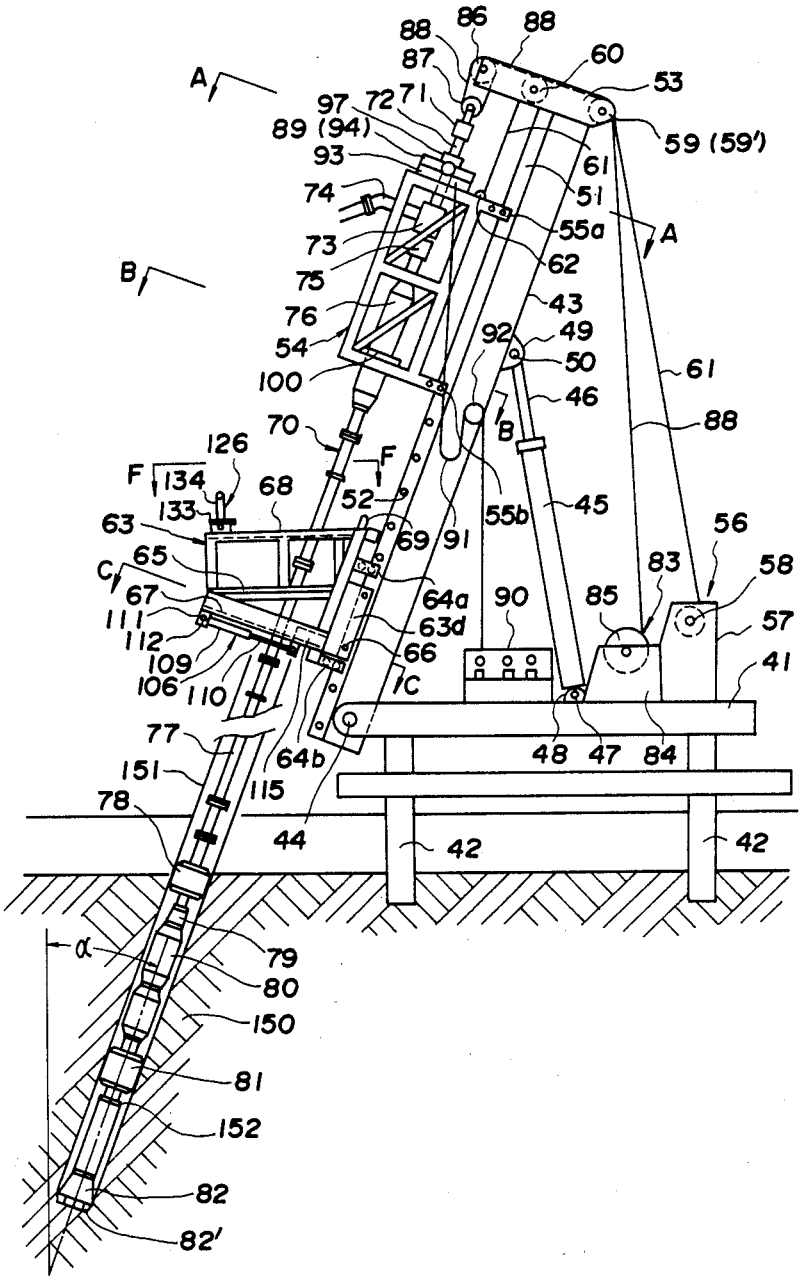

Referring now to FIG. 5, a first embodiment of the present invention applied to an inclined shaft drilling rig is shown in operating position. This embodiment is used for drilling inclined shafts into which posts are driven, for laying a submarine pipeline. A steel pipe 151 is previously driven into the submarine ground 150 by a pile driver (not shown) with the pipe 151 tilted at an angle $\alpha$ with respect to the vertical. An inclined shaft is drilled inside the steel pipe 151.

FIGS. 6 to 16 each show the detail of various components of the inclined shaft drilling rig shown in FIG. 5.

The inclined shaft drilling rig shown in these Figures comprises, as shown in FIG. 5, a platform 41 supported by legs 42 driven in the submarine ground 15. The platform 41 has tiltably pivoted thereon a leader 43 for drill string, and a cylinder 45 for adjusting the tilt angle of the leader 43 and which also serves as stay. There are further installed on the platform 41 a winch frame 57 for a first frame hanging unit 56 and a winch mounted in the frame 57, a winch frame 84 for a drill string hanging unit 83 and a winch mounted in the frame 84, and an oil pump unit 90 for a rotary drive unit 89 for drill string.

Said leader 43 is tiltably installed by means of a pin 44 on the platform 41 at the front end thereof as shown in FIG. 5. There are disposed between this leader 43 and platform 41 the cylinder 45 mounted by means of a bracket 47 and pin 48 to the platform 41 and which also serves as a stay, and a piston rod 46 fitted in the cylinder 45 and further coupled by means of a bracket 49 and pin 50 to the leader 43. As the piston rod 46 is extended or contracted, the leader 43 is adjustable to a tilt angle $\alpha$ of the steel pipe 151 driven in the ground 150 and supported at the adjusted angle. Also the leader 43 has provided at the front thereof two parallel guide rails 51 for the first and second frames. The guide rails 51 have provided equidistantly spaced along the section thereof from near the middle of the length to the bottom end thereof a plurality of first pin holes 52 for fixing the second frame 63. Further, the leader 43 has fixed at the top thereof an upper frame 53 for hanging the top of the first frame 54, and consequently the top of the drill string, and at the front upper portion thereof the first frame 54 as well as at the front lower portion thereof the second frame 63.

Figure 6:
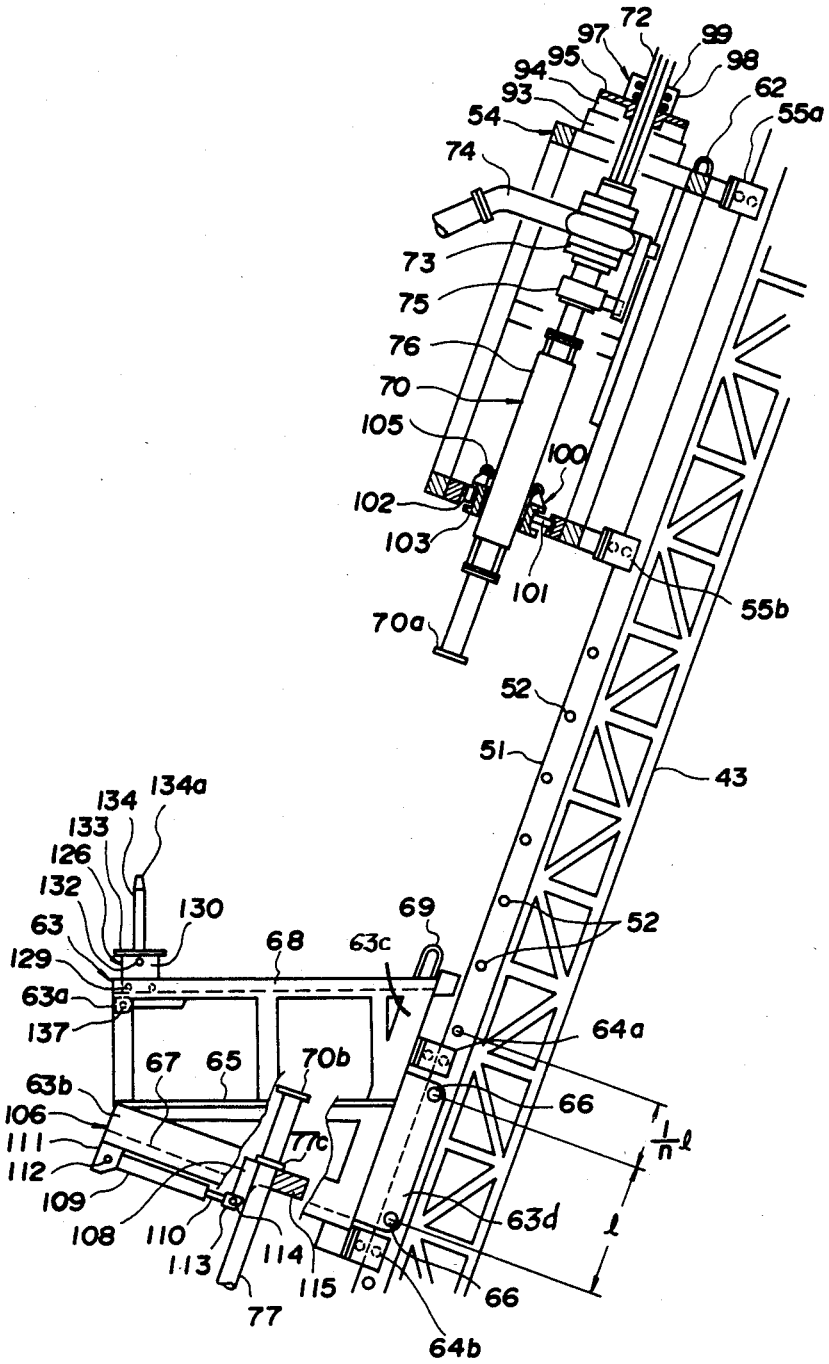

Said first frame 54 has provided at the top and bottom thereof guide units **55*a* and 55*b*, respectively, as shown in FIGS. 5 and 6, which are equipped with two guide rollers engaged on the guide rails 51. Said first frame 54 is so mounted as to be vertically movable along the guide rails 51 by means of the guide units 55*a* and 55*b*. Said first frame 54 is supported by the hanging unit 56. As seen in FIG. 5, the hanging unit 56 is composed of a winch 58 installed in the winch frame 57, sheaves 59 and 60 installed on the upper frame 53 fixed to the leader 43, and a wire rope 61 which is unwound from the winch 58, passed over the sheaves 59 and 60, and fixed to the hanging bracket 62 mounted on the top end of the first frame 54. As the winch 58 of the hanging unit 56 winds or unwinds the wire rope 61, the first frame 54 is raised or lowered along the guide rails 51 and thus can be held at a desired position on the guide rails 51. Furthermore, said first frame 54 has provided at the upper portion thereof members of a rotary drive unit 89 for the drill string which will be described in further detail, except for the oil pump unit 90, and a guide unit 97, and at the lower portion thereof a guide unit 100** for the lower portion of the drill string.

Figure 11:
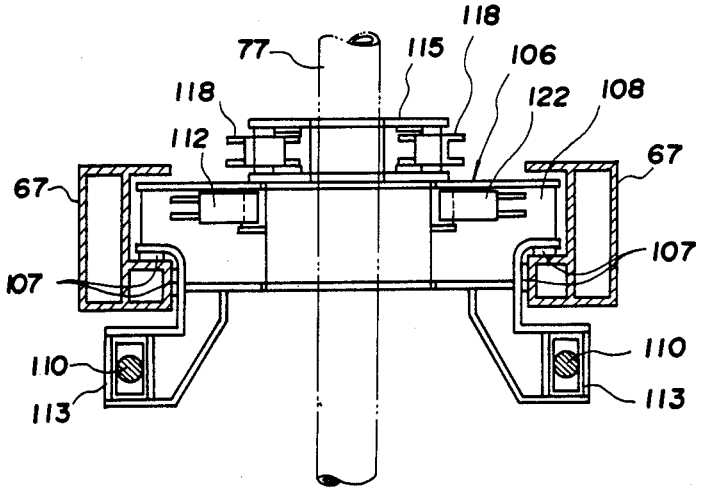
Figure 12:
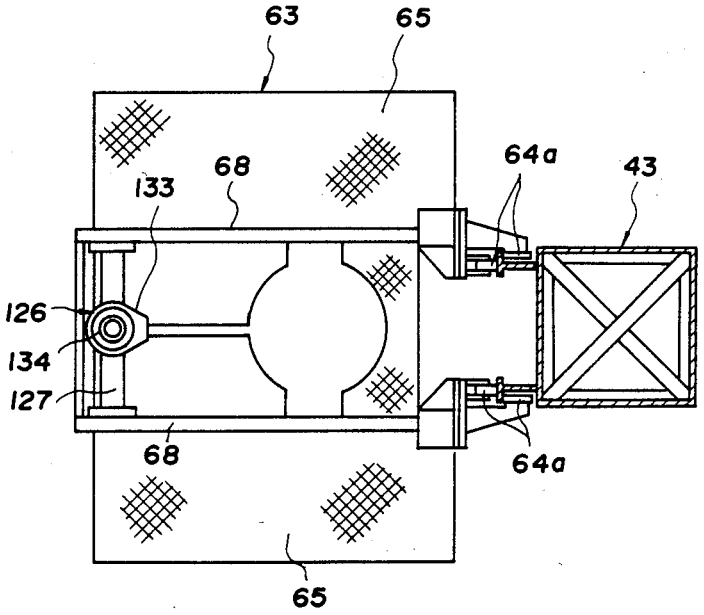

On the other hand, the second frame 63 is composed, as shown in FIGS. 5 and 6, of a first component member 63*a* disposed nearly horizontally, a second component member 63*b* disposed perpendicularly to the leader 43 below the first component member 63*a*, and a third component member 63*c* disposed at the lateral sides of said first and second component members 63*a* and 63*b* on the side of the leader 43, which are all connected integrally. The first component member 63*a* of the second frame 63 has provided at the upper portion thereof, as shown in FIGS. 5, 6 and 12, guide rails 68 for supporting an adjoining jig 126, which will be described in further detail later, as means for receiving an additional drill string component, and a scaffold 65 mounted below the guide rails 68. Two guide rails 68 for said adjoining jig 126 are parallelly disposed in a nearly horizontal plane and spaced on opposite sides of the drill string 70 so as to move the adjoining jig 126 between a parking position and a position where a new drill string component is to be added to the drill string. Said scaffold 65 is designed to be sufficiently wide to project to the opposite sides of the first component member 63*a* of the second frame 63, as shown in FIG. 12, and installed nearly horizontally, thereby enabling the work of adding a new drill string component to be done at the opposite sides of the first component member 63*a* of the second frame 63. Note that the scaffold 65 may be so designed as to be foldable at the opposite sides of the first component member 63*a* of the second frame 63. The second component member 63*b* of the second frame 63 has connected thereto, as shown in FIGS. 5, 6 and 11, a holding means 106, as will be described later, the lower half of the drill string, a slide frame 108 for the holding means 106, and guide rails 67 for holding plate 115. Two guide rails 67 are spaced parallelly at opposite sides of the drill string 70 so as to move said slide frame 108 and holding plate 115 between a position where the drill string is held at the lower half portion thereof and a parking position away from the drill string 70. The third component member 63*c* of the second frame 63 has installed at the top end thereof a hanging bracket 69, at the upper and lower lateral sides thereof on the side of the leader 43 guide units 64*a* and 64*b*, respectively, and at the intermediate portion thereof on the side of the leader 43 a fixing plate 63*d*, as shown in FIGS. 5 and 6. Each of the guide units 64*a* and 64*b* has two guide rollers engaged on guide rails 51 installed on the leader 43, as seen in FIGS. 5 and 6. The second frame 63 is mounted vertically movable along the guide rails 51 by means of the guide units 64*a* and 64*b*. Said fixing plate 63*d* has provided two second pin holes (not shown) vertically spaced. These second pin holes and the first pin holes 52 formed in the guide rails 51 on the leader 43 are so formed that as seen from FIG. 6, when it is assumed that the space between the second pin holes is l, the space between the first pin holes 52 is l/n (n=1, 2, 3, . . . and l/n>d when the diameter of the pin hole is d). Therefore, the second pin holes can be selectively overlapped on the first pin holes 52. The second frame 63 can be adjusted to a desired vertical position and fixed in the adjusted position according to the projecting length of the steel pipe 151 from the earth 150, owing to the coupling construction in which the second frame 63 is vertically moved along the guide rails 51 while driven via the guide units 64*a* and 64*b* by means of the wire rope from the auxiliary hanging unit (not shown) and which is connected to said hanging bracket 63 installed on the third component member 63*c* of the second frame 63, and in which set pins 66 are inserted from outside of the leader 43 into the first selected and second pin holes overlapped one on another.

Figure 7:
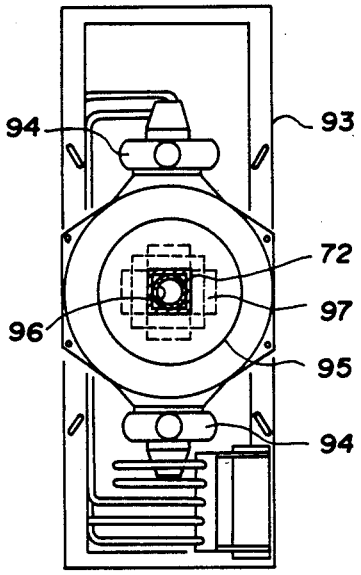
Figure 8:
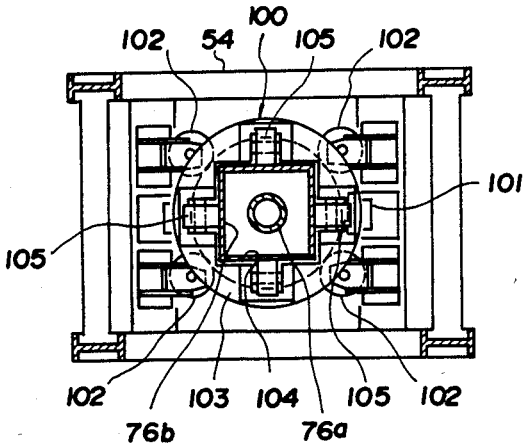

Said drill string 70 comprises, from the above as shown in FIG. 5, a swivel joint 71, kelly bar 72, another swivel joint 73, air swivel joint 75, guide pipe 76, drill pipe 77, stabilizer 78, joint pipe 79, drill collar 80, another stabilizer 81 and a drill bit 82, connected together. Said upper swivel joint 71 is so arranged as not to transmit the rotation of the drill string 70 to the sheave 87 of the hanging unit 83 for the drill string, which will be described later. Said kelly bar 72 is designed to have a section of a hollow square as shown in FIG. 7, and it transmits the turning force for drilling from the rotary drive unit 89 to the entire drill string 70, as well as enables the axial movement of the drill string 70. It should be noted that the kelly bar 72 may be designed to have any other section than that of such hollow square if it is of other than a hollow circular section. The lower swivel joint 73 is provided with an inner housing having a slush discharge port and which is rotated as connected with said kelly bar 72, nonrotatable outer housing, elbow 74 for connection of a delivery hose, as well as mud sealing member and bearing (both not shown). This swivel joint 73 is so designed as to discharge the slush which has entered the inner housing, through said discharge port into a passage defined by the inner and outer housings, and through the elbow 74 to outside. Said air swivel joint 75 comprises an inner housing rotatable together with the inner housing of the lower swivel joint 73, outer housing not rotatable but connected to an air compressor, air sealing member and bearing (both not shown). Thus, the air swivel joint 75 feeds compressed air from said air compressor into the space between the inner and outer housings. The action of air lift of this compressed air is utilized to suck up the slush into the drill string 70. In this embodiment, said guide pipe 76 is composed, as shown in FIG. 8, of an inner housing 76*a* with a circular section, and an outer housing 76*b* of a square section, which are integrally connected. Said outer housing 76*b* is designed to be thick at the outer portion thereof for improved mechanical strength so that when a new drill string component is added to the drill string, the possible turn-down of the upper half of the drill string which is disconnected is minimized as during drilling, a bending load acting on the drill string 70 can be received. Further, the guide pipe 76 is so supported as to be rotatable and axially movable through the fitting of the outer housing 76*b* into a hole 104 formed in a guide disk 103 of the lower guide unit 100 which will be described later, provided on the first frame 54. Note that the outer housing 76*b* of said guide pipe 76 may have a section other than square one, and they may be noncircular or spline-connected to each other. Said drill pipe 77 has provided nearly at the middle portion in the axial direction a connection which is engaged on a holding plate 115 of a holding means 106 on the lower half of the drill string, which will be described later, when adding a new drill string component to the drill string. This connection is indicated by the reference numeral 77'c for an additional drill pipe 77' in FIGS. 18 to 23. Such drill pipes 77 are added one after another as an inclined shaft is drilled deeper and deeper. Said stabilizers 78 and 81 are disposed in the steel pipe 151 which serves to prevent the ground from collapsing and stabilizes the drill string, and they keep the drilling direction of an inclined shaft and prevent the drill string 70 from being oscillated while it rotates. Said joint pipe 79 is provided to connect to each other drill string components of the drill string 70 which have the diameter of the flange at one end thereof being different from that at the other end. Said drill collar 80 comprises an inner housing which has at the bottom end thereof a flange of a diameter somewhat larger than that of an outer housing, the outer housing having a diameter which can define a cylindrical space between the inner housing and the outer housing and which is located on said flange, a lead or weight provided in the space between said inner and outer housings, a connection installed at the bottom of the flange of the inner housing and which connects to a drill string component located below the drill collar 80, connection disposed above the inner and outer housings and which connects integrally both the housings to each other and connects with a drill string component located above the drill collar 80, and a cylindrical weight (not shown) which is to be disposed on said flange and outside of the outer housing when it is necessary to add a special weight to the drill string. The drill collar 80 is so arranged as to hold, when the ground 150 is hard, the flange of inner housing of the drill collar 80 which has already been installed, engaged on a slide frame 108 of the holding means 106 for the lower half of the drill string, which will be described later, and also to add another drill collar on said flange. Said drill bit 82 is used to drill an inclined shaft by means of the cutter 82' thereof.

The hanging unit 83 for the drill string comprises, as shown in FIG. 5, the winch 85 mounted in the winch frame 84 installed on the platform 41, sheaves 59' and 86 mounted in the upper frame of the leader 43, sheave 87 mounted atop the swivel joint 71 of the drill string 70, and a wire rope 88 which is unwound from the winch 85 and passed over said sheaves 59', 86 and 87 and is connected at the end to the fixing member such as the upper frame 53. The hanging unit 83 is so designed as to raise or lower the drill string 70 as the wire rope 88 is wound or unwound by the winch 58.

The rotary drive unit 89 for the drill string comprises the oil pump unit 90 installed on the platform 41 as shown in FIG. 5, hydraulic motor 94 installed on a frame 93 installed at the upper portion of the first frame 54 as shown in FIGS. 5 and 6, transmission gear (not shown), and a rotary frame 95 provided with an engagement hole 96 for the kelly bar of the drill string 70 as shown in FIG. 7. As shown in FIG. 5, the hydraulic motor 94 is connected to the oil pump unit 90 by means of the hose 91 which is held by an intermediate holder 89 provided at the middle of the leader 43. This rotary drive unit 89 is so arranged that the kelly bar 72 of the drill string 70 is engaged in the engagement hole 96 formed in the rotary frame 95 so as to be vertically movable, a turning force is transmitted from the hydraulic motor 94 through the transmission gear and rotary frame 95 to the kelly bar 72, and thus a turning force for drilling is imparted to the drill string 70.

The drill string 70 is supported, as shown in FIGS. 5 and 6, by the upper guide unit 97 provided on the rotary frame 95 of the rotary drive unit 89 to guide the kelly bar 72, and the lower guide unit 100 provided at the lower portion of the first frame 54 to guide the guide pipe 76.

The upper guide unit 97 is provided, as shown in FIG. 6, with guide rollers 99 installed on the frame 98 on the rotary frame 95. These guide rollers 99 are disposed side by side around, and in the axial direction of, the kelly bar 72.

On the other hand, the lower guide unit 100 comprises, as shown in FIGS. 6 and 8, a plurality of rollers 101, four lower guide rollers 102, guide disk 103 for engagement with the guide pipe 76 of drill string 70, and four upper guide rollers 105 installed at the upper portion of the guide disk 103 and disposed around the drill string 70. Said guide disk 103 is formed in the shape of a drum, and has formed in the center thereof, as shown in FIG. 8, a square-shaped engagement hole 104 which fits the outer housing of a square section of the guide pipe 76 of drill string 70. Furthermore, the guide disk 103 is supported rotatably by said rollers 101 and lower guide rollers 102. The guide pipe 76 is inserted into a space defined by the four upper guide rollers 105, and engaged in the engagement hole 104 formed in the guide disk 103. Therefore, the lower guide unit 100 is so arranged that the guide disk 103 is rotated along with the guide pipe 104 through the engagement of the guide pipe 76 in the engagement hole 104 in the guide disk 103, thereby capable of guiding the guide pipe 76 in the axial direction owing to the engagement of the upper guide rollers 105 in the engagement hole 104 in the guide disk 103.

Figure 9:
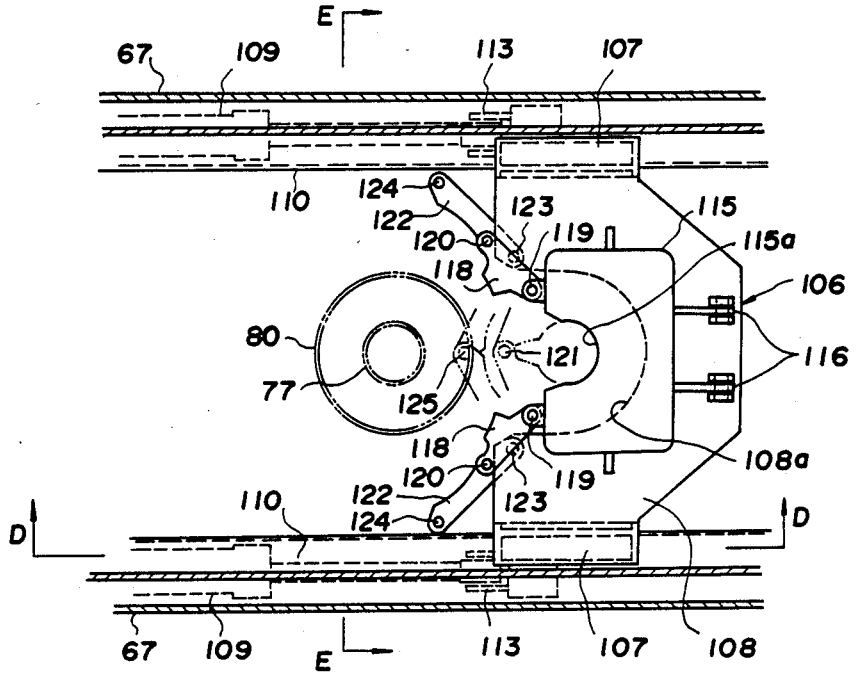
Figure 10:
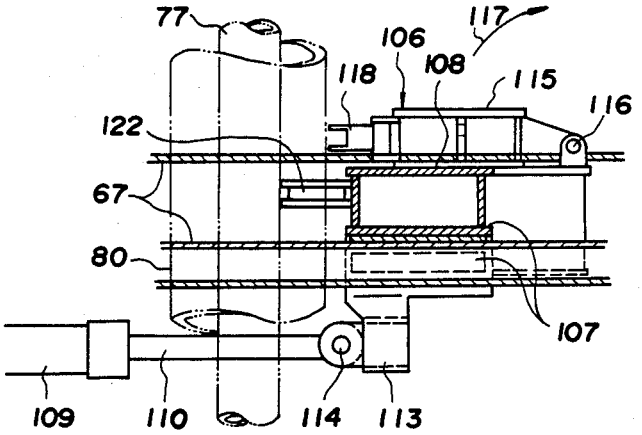

In the embodiment shown, the holding means for holding the drill string, at the lower half, as disconnected when a new drill string component is to be added to the drill string, is so designed as to hold any one of the drill pipe 77 and drill collar 80 of which the outside diameter is larger than that of the drill pipe 77. This holding means 106 is comprised, as shown in FIGS. 5, 6, 9 and 11, of a slide frame 108 slidably supported by means of a guide member 107 on the guide rails 67 installed on the second component member 63b of the second frame 63, two cylinders 109 to move the slide frame 108, piston rod 110 inserted in each of said cylinders 109, receiving seat plate 115 provided on the slide frame 108, a first pair of two dogs 118 mounted on the receiving seat plate 115, and a second pair of two dogs 122 mounted on the slide frame 108. Each of the cylinders 109 is connected, as shown in FIGS. 5 and 6, with a bracket 111 mounted at the lower portion of the second component member of the second frame 63 by means of a pin 112. Each of the piston rods 110 is, as shown in FIGS. 6 and 10, connected with bracket 113 provided at the lower part of the slide frame 108 by means of a pin 114. As the piston rod 110 is extended or contracted, the slide frame 108 and its associated members are moved along the guide rails 67 between a position where the lower half of the drill string is held, and a parking position. Said holding plate 115 is, as shown in FIGS. 9 and 10, mounted openably and closably about a hinge 116. Also the holding plate 115 has formed therein a first engagement hole 115a in which nearly a half of the circumferential surface of the drill pipe 77 can be engaged, and further it has mounted at the end face thereof the first one of said pair of two dogs 118 by means of a hinge 119. When they are used to hold the drill pipe 77 at the top of the lower half of the drill string, the holding plate 115 is set with superposed first dogs 118 as shown in FIGS. 9 to 11, while the first dogs 118 will be moved to be opened, respectively, to the holding positions on the side of the lower half of the drill string as shown by solid lines in FIG. 9. At these positions, the drill pipe 77 at the top of the lower half of the drill string as disconnected is made to engage in the first engagement recess 115*a*, the connection provided in the intermediate point in the intermediate position in the axial direction of the drill pipe 77 is received by the holding plate 115, then each of the first pair of dogs 118 is pivoted as indicated with imaginary line in FIG. 9, the pin holes formed in the ends of each dog in the first pair are superposed on each other and a set pin 121 is inserted into both the pin holes 120 as aligned, thereby holding the lower half of the drill string. On the other hand, the slide frame 108 has formed therein, as shown in FIG. 9, a second engagement recess 108*a* coaxial with the first engagement hole 115*a* and in which nearly a half of the outer circumferential surface of the drill collar 80 can be engaged, and it also has mounted at the end thereof said second pair of two dogs 122 by means of a hinge 123. When they are used to hold the existing drill collar 80 in order to add a new drill collar 80, said slide frame 108 and second dogs 122 will be opened with said holding plate 115 turned in the direction of arrow 117. With the dogs 122 kept opened, respectively, they are moved to a position where the existing drill collar 80 is to be held. At that position, the existing drill collar 80 is engaged in the second engagement recess 108*a*. The flange fixed at the bottom end of the inner housing of said existing drill collar 80 is received by the slide frame 108, and then the second dogs 122 are pivoted to the position indicated by imaginary line in FIG. 9 so that the pin holes 124 formed in the ends of the second dogs 122 are superposed on each other. The set pin 125 is inserted into the superposed pin holes 124, thus holding the existing drill collar 80.

It should be noted that when adding a new drill string component, the lower junction, namely, the junction between the top end of the lower half of the drill string held by said holding means 106 and the bottom end of the upper half of the drill string after addition of the new drill string component, and the junction between the drill collar 80 already installed on the drill string and the new drill string 80, are so positioned between the guide rails 68 for the adjoining jig 126 provided on the second frame 63 and the scaffold 65 that the work of adding a new drill string component can easily be done (refer to FIGS. 17 to 23).

Figure 13:
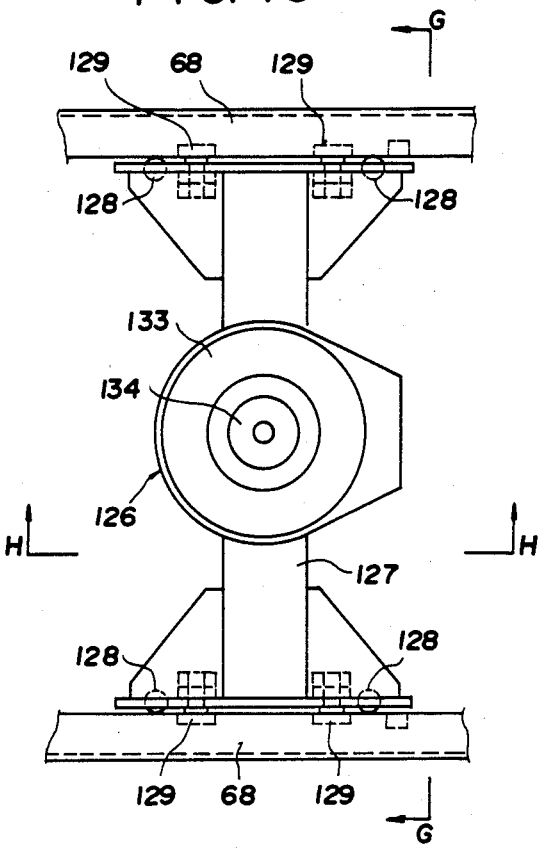
Figure 14:
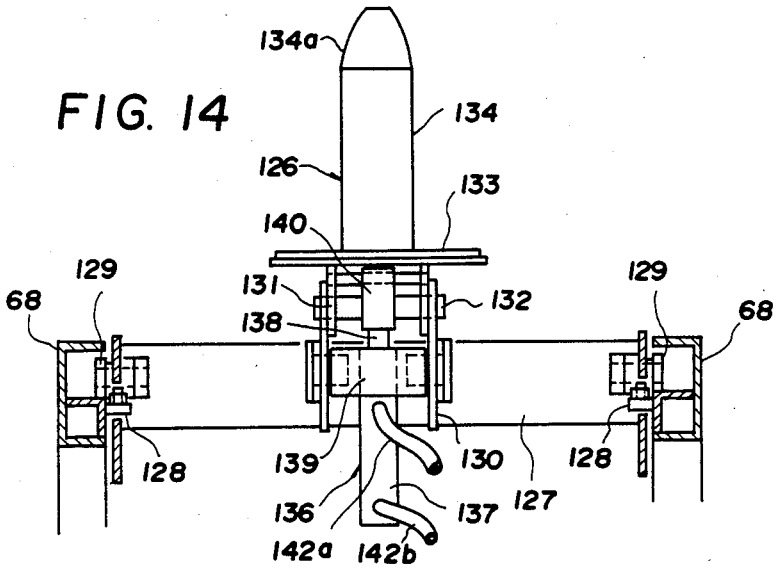
Figure 15:
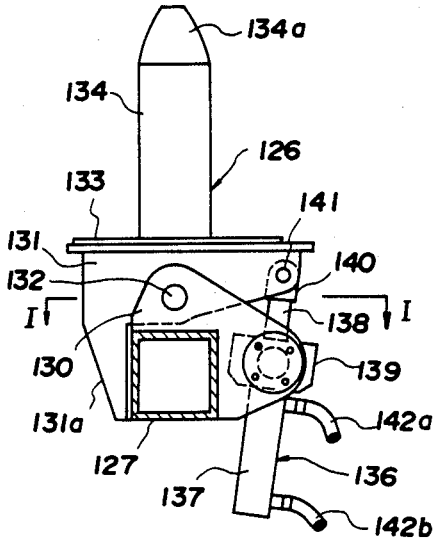
Figure 16:
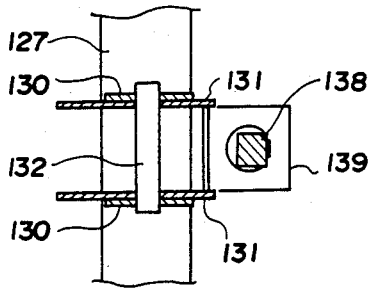

The adjoining jig 126 for receiving said additional drill string component comprises, as shown in FIGS. 5, 6, and 12 to 16, a slide frame 127 mounted on the guide rails 68 installed at the upper portion of the first component member 63*a* of the second frame 2, first bracket 130 fixed to the slide frame 127, second bracket 131 coupled with said first bracket 130 by means of a pin 132, receiving seat 133 mounted on said second bracket 131, stand pin 134 provided integrally with the top surface of said receiving seat 133, and a jack unit 136 for tilting the receiving seat 133 and stand pin 134. Said slide frame 127 is so arranged, as shown in FIGS. 13 and 14 in a larger scale, as to be movable along the guide rails 68 by means of guide rollers 128 and 129 between a position where the additional drill string component is added and the parking position. Said receiving seat 133 is so designed as to receive the bottom end of the additional drill string component. The outside diameter of said stand pin 134 is so selected as to guide a tubular component of the additional drill string components along the bore thereof. The end 134*a* of the stand pin 134 is tapered for easy engagement of the bore of the additional drill string component. The tubular ones of the drill string components are so designed as to have a bore for smooth pass of slush and other fluid as has been previously described. The stand pin 134 is so formed as to use the bore of said drill string component in order to support a drill string component of which the outside diameter is different from that of other components. Said jack unit 136 is composed of a cylinder 137 installed on the first bracket 130 by means of a mount block 139, and a piston rod 138 inserted in said cylinder 137 and which is coupled with another bracket 140 by means of a pin 141. With this jack unit 136, a working pressure is fed from the upper hose 142*a*, shown in FIGS. 14 and 15, to the cylinder 137 to contract the piston rod 138 so that the second bracket 131 is pivoted about the pin 132 which couples the first and second brackets together. Thus, the center axis through the receiving seat 133 and stand pin 134 can be aligned by means of the second bracket 131 with the connection of the upper half of the drill string as disconnected. When a working pressure is fed from the lower hose 142*b* to the cylinder 137 to extend the piston rod 138, the receiving seat 133 and stand pin 134 are returned to their initial postures. At this time, the stopper 131*a* forced by the second bracket 131 abuts the lateral side of the slide frame 127 as shown in FIG. 15, and the receiving seat 133 and stand pin 134 are returned to their vertical postures. In this embodiment, the receiving seat 133 and stand pin 134 are so arranged as to be tilted together. However, note that such an arrangement may be that only the stand pin 134 is tilted. Also in the embodiment shown, the workers should move the adjoining jig 126 along the guide rails 68. It will be apparent to those skilled in the art that the adjoining jig may be moved using a fluid pressure cylinder, etc.

Here, the operation of the embodiment of inclined shaft drilling rig will be explained below with reference to FIGS. 5 to 16, and 17 to 23.

In order to drill an inclined shaft, the tilt angle of the leader 43 is adjusted by means of the cylinder 45 installed on the platform 45 until the center line of the drill string 70 is alinged with that of a steel pipe 151 previously driven in the earth and tilted at an angle of $\alpha$. Then the leader 43 is supported by the cylinder 45 at the adjusted angular position.

Then, the drill string 70 supported by the first frame 54 mounted on said leader 43 is supplied with a turning force for drilling from the rotary drive unit 89, while being pulled down by the hanging unit 83 for the drill string. The drill string 70 is given a thrust for drilling owing to its own weight and the weight of drill collar 80, thereby drilling an inclined shaft inside the steel pipe 151 previously driven into the earth 150.

During the drilling of such inclined shaft the slide frame 108 of the holding means 106 for drill string and holding plate 115 are moved to and stopped at the parking position away from the position of the drill string 70.

During the drilling, slush is sucked up through the bore of the drill string 70 and discharged outside through the bend 74 connected to the swivel joint 73 and the hose connected to the bend 74.

When the earth has been drilled to a depth equivalent to the length of a drill pipe 77, a new drill pipe 77' is added to the drill string in the following procedure:

The drill string 70 is made to stop rotating and lowering, and then it is raised by the hanging unit 83 until the flange 77*c* provided in the intermediate position in the axial direction of the drill pipe 77 comes to a position slightly above the holding plate 115 of the holding means 106 for the drill string and which is provided at the bottom of the second frame 63.

Then, the holding plate 115 is superposed on the slide frame 108 of the holding means 106 for drill string, as shown in FIGS. 9 to 11, and with the first and second dogs 118 and 122 opened, the piston rod 110 is contracted by the cylinder 109 so as to move said slide frame 108 and holding plate 115 from the parking position to a position where the lower half of the drill string is to be held. At this position, the drill pipe 77 is engaged in the first engagement recess 115*a* formed in the receiving seat plate 115, the pin holes formed in the ends of first pair of dogs 118 are superposed one each other, and the set pin 121 is inserted into the superposed pin holes to couple the dogs. In case of adding a such drill pipe, the second engagement recess 108*a* formed in the slide frame 108 of the holding means 106 and the second pair of dogs 122 are not used.

Next, the drill string 70 is lowered by unwinding the wire rope from the drill string hanging unit 83, and the connection 77*c* provided at the intermediate point in the axial direction of the drill pipe 77 is received by the holding plate 115 of the drill string holding means 106, thus holding the drill string 70.

Figure 17:
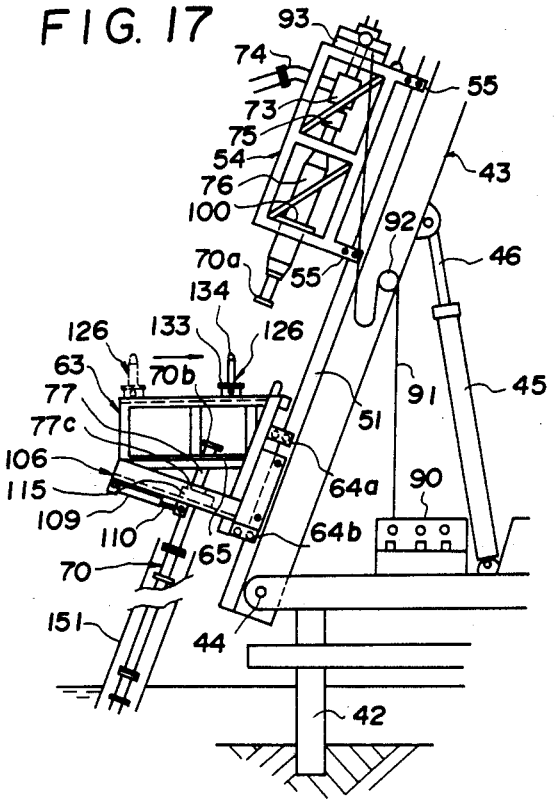

After the drill string 70 is disconnected at the connection just above the drill pipe 77 held by the holding plate 115 of the drill string holding means 106, the displate connected drill string is hoisted at the upper half thereof by the drill string hanging unit 83 as shown in FIG. 17 to define between the lower and upper halves of the drill string a space necessary for adding a new drill pipe 77' to the drill string.

In this condition, the upper half of the drill string to which the new drill pipe 77' is to be added and the top end of the lower half of the drill string to be connected with the lower half of the drill string are set between the guide rails 68 of the adjoining jig 126 at the second frame 63 and the scaffold 65, whereby the work of adding the new drill component can be easily done.

Next, with the receiving seat 133 of the adjoining jig 126 and stand pin 134 oriented vertically, the adjoining jig 126 is moved along the guide rails 68 from the parking position indicated with imaginary line in FIG. 17 to a position indicated with solid line, namely, a position where the center of the pin 132 coupling the first and second brackets 130 and 131 of the adjoining means 126 to each other is almost aligned with the extended center line of the upper half of the disconnected drill string.

Figure 18:
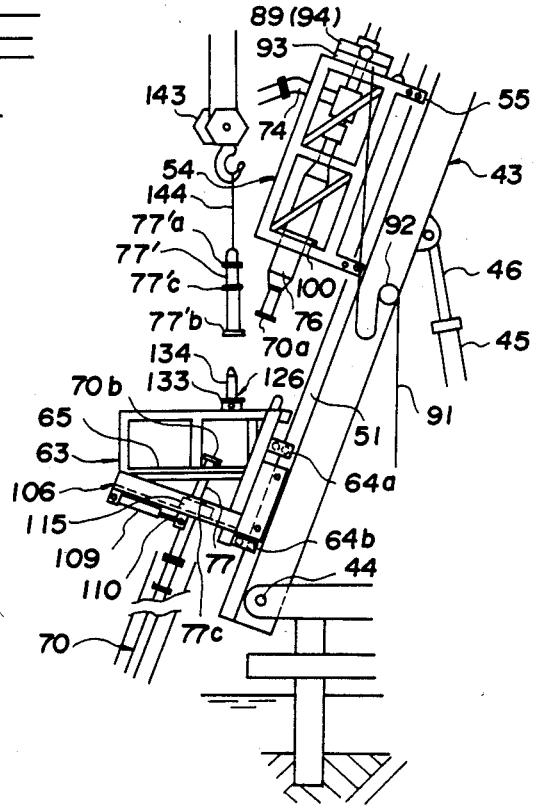
Figure 19:
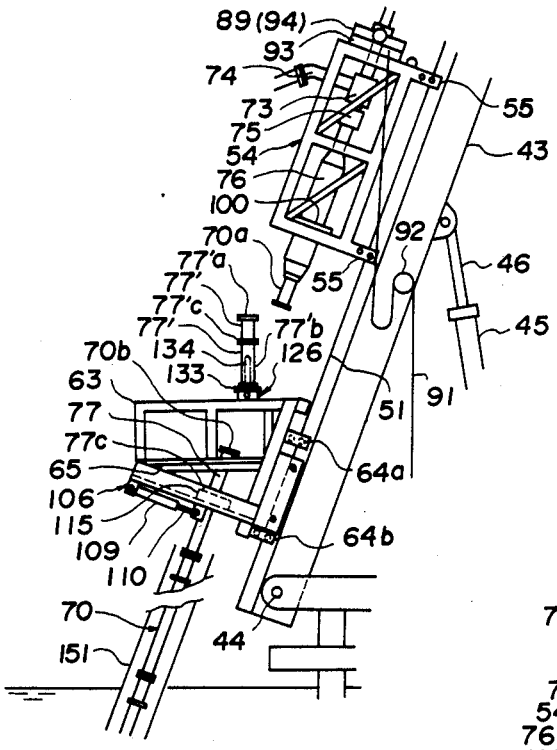

A new drill pipe 77' to be added is nearly vertically hoisted by the wire rope 144 suspended from the hanger 143 and lowered toward the stand pin 134 of the adjoining jig 126, as shown in FIG. 18. Then, the additional drill pipe 77' is fitted at the inner circumference thereof into the stand pin 134 of the adjoining jig 126 at the outer circumference, the connection 77'*b* provided at the bottom end of the drill pipe 77' is received on the receiving seat 133 of the adjoining jig 126, and the the additional drill pipe 77' is supported by the adjoining jig 126. Thereafter, the wire rope 144 is untied and the hanger 143 is returned.

Figure 20:
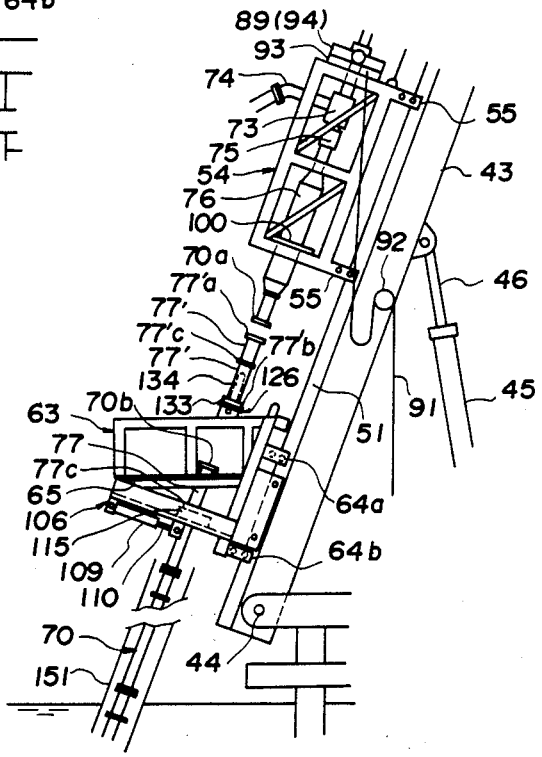
Figure 21:
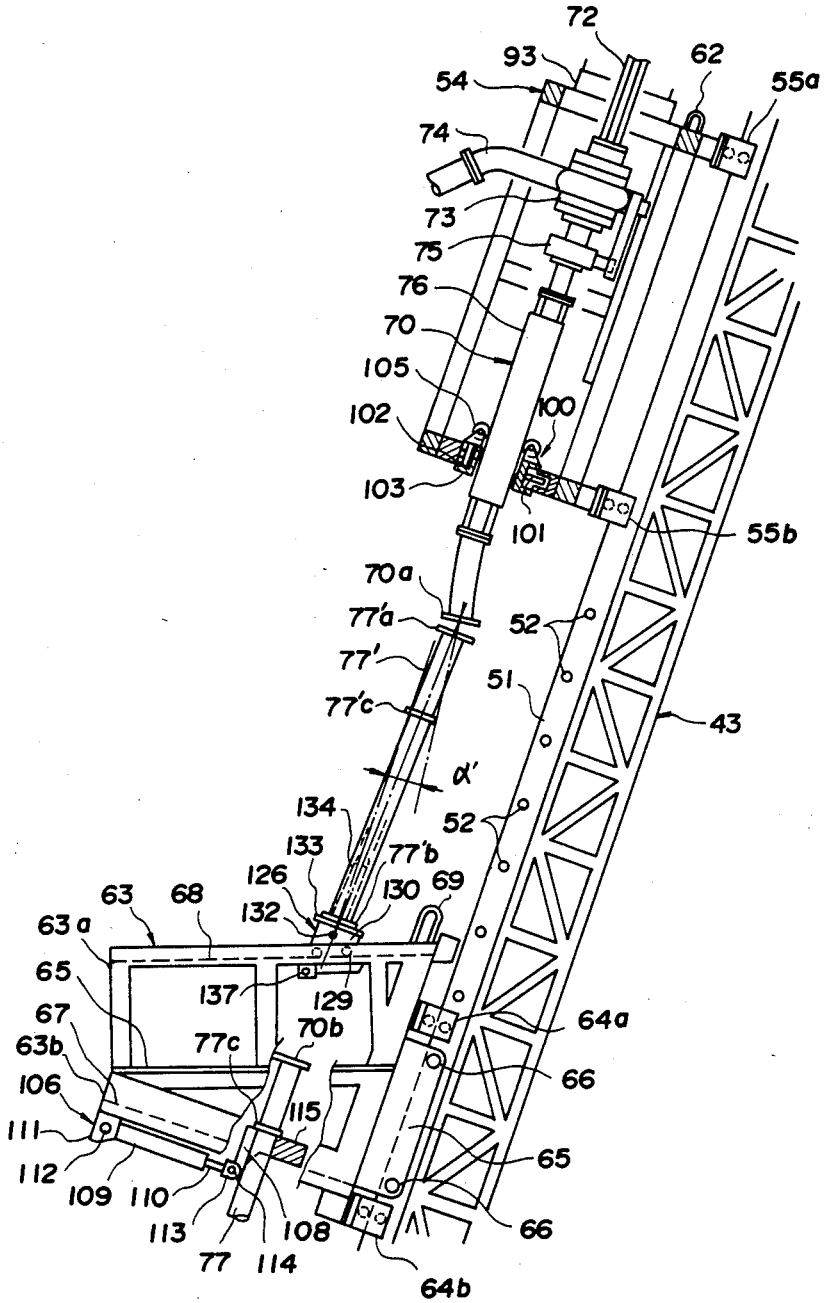
Figure 22:
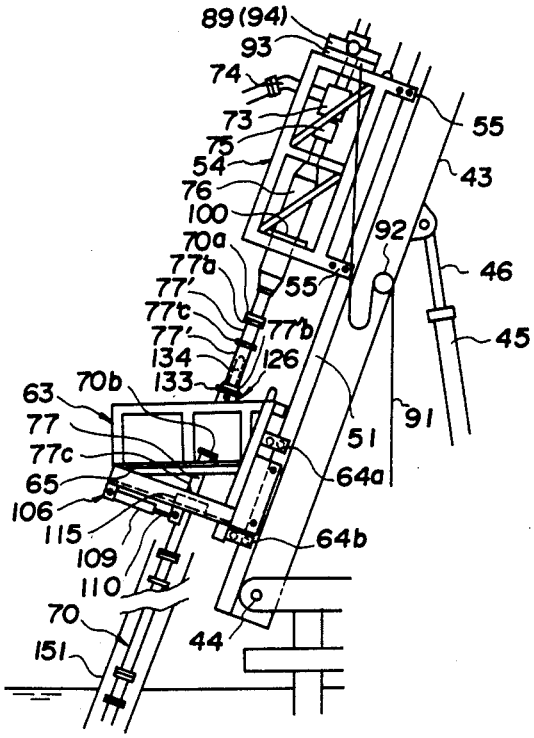

Further, the piston rod 138 is contracted by means of the cylinder 137 of the jack unit 136 to pivot the second bracket 131 about the pin 132, thereby tilting the receiving seat 133 of the adjoining jig 126 and the stand pin 134, as shown in FIGS. 20 and 21, so that the axis of the additional drill pipe 77' is aligned with that of the upper half of the disconnected drill string.

As seen from FIG. 6, in this embodiment, the upper half of the disconnected drill string is supported by the guide units 97 and 100 provided with a relatively large space between them at the upper and lower portions of the first frame 54, the outer housing 76*b* of the guide pipe 76 for the flucrum of the lower portion is thick for improved mechanical strength, and the guide unit 100 supporting said guide plate 76 is also designed mechanically strong, all for minimizing as much as possible the possible tilt of the upper half of the disconnected drill string due to its own weight. However, since there is a clearance between said guide pipe 76 and guide unit 100, and between the component members of the guide unit 100, some tilt of the upper half of the drill string occurs as shown with the tilt angle $\alpha'$ in FIG. 21. The adjoining jig 126 is so arranged that also when the upper half of the disconnected drill string tilts, the receiving seat 133 and stand pin 134 are tilted by the jack unit 136 correspondingly to the tilt angle $\alpha'$ of the upper half of the drill string so that the connection 77*a* at the top end of a new drill pipe 77' can be easily joined to the connection 70*a* at the bottom end of the upper half of the drill string. Note that in FIG. 21, the tilt angle $\alpha'$ of the upper half of drill string is shown as considerably exeggerated for the simplicity of illustration.

Thus, a new drill pipe 77' is received by the adjoining jig 126 and can be easily positioned adjacent to the upper half of the drill string, thereby eliminating the dangerous work for the workers.

The upper half of the disconnected drill string is lowered by the drill string hanging unit 83 until the connection 70*a* at the bottom end of the upper half of the drill string abuts the connection 77'*a* at the top end of the additional drill string. Then, the connections are joined together by bolts or the like.

After the additional drill pipe 77' is added to the upper half of the drill string as described above, the upper half of the drill string is hoisted by the drill string hanging unit 83 until the added drill pipe 77' completely leaves the stand pin 134 of the adjoining jig 126. Thereafter, the adjoining jig 126 is returned to the parking position as shown in FIG. 23.

Figure 23:
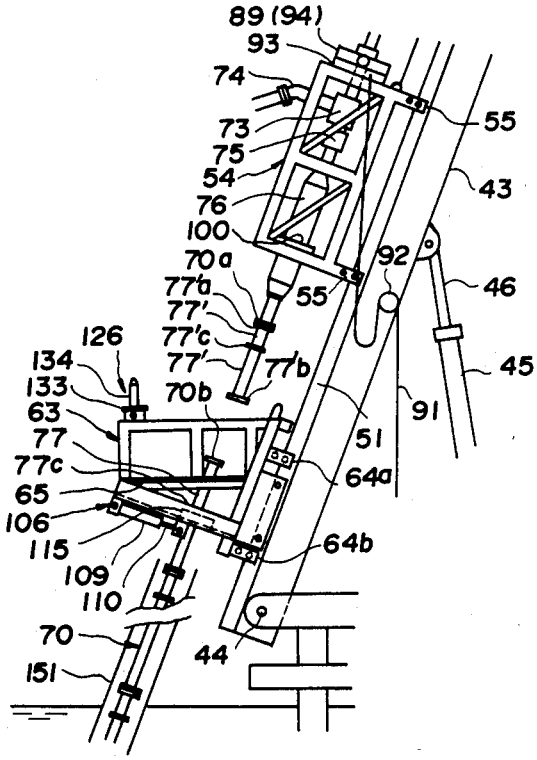

The upper half of the drill string to which the new drill pipe 77' has been added is lowered from the position shown in FIG. 23 until the connection 77'*b* at the lower portion of the added new drill pipe 77' abuts the connection 70*b*-at the top end of the lower half of the drill string which is held by the holding means 106. Then, the connection 77'*b* is positioned on the connection 70*b* and joined to each other by bolts or the link, thus assembling a drill string to which one drill pipe 77' has been newly added.

The connection 70*b* at the top end of the lower half of said drill string can be easily joined, by the workers standing at ease, to the connection 77'*b* at the bottom end of the drill pipe 77' added to the upper half of the drill string since, as has been described above, the connection 70*b* at the top end of the lower half of the drill string is set between the guide rails 68 of the adjoining jig 126 and the scaffold 65 on the second frame 63.

After adding a new drill pipe 77' to the drill string, the drill string 70 as a whole is a hoisted by the drill string hanging unit 83 to separate the holder 77*c* at the intermediate position of the drill pipe 77 from the holding plate 115 of the holding means 106 which has held the lower half of the drill string, and then the set pin 121 is extracted from the first pair of dogs 118 of the holding means 106 so that the dogs are opened, and the piston rod 110 is extended by means of the cylinder 109 of the holding means 106 to return the slide frame 108 and its accessory members to the parking position.

A turning force for drilling is given again from the rotary drive unit 89 to the drill string 70 while the drill-string hanging unit 83 is lowered to impart a thrust for drilling to the drill string, thereby resuming the earth drilling.

The above-mentioned operation is repeated to drill an inclined shaft inside the steel pipe 151 to a predetermined depth.

In order to add a new drill collar 80 when the earth 150 is very hard, the addition of drill collar 80 is done in the following procedure:

The drill string is hoisted by the drill string hanging unit 83 so that the bottom of the flange provided at the bottom of the inner housing of the drill collar 80 comes above the slide frame 108 of the drill string holding means 106, the holding plate 115 of said holding means 106 is pivoted in the direction of arrow 117 in FIG. 10, and the piston rod 110 is contracted by means of the cylinder 109 with the second pair of dogs 122 opened, thereby moving the slide frame 108 from the parking position to a position where the existing drill collar is held.

At this position, the existing drill collar 80 is engaged in the second engagement recess formed in the slide frame 108 of the holding means 106, the second pair of two dogs 122 are closed, and the pin holes 124 formed in the ends of the second dogs 122 are superposed on each other. The set pin 125 is inserted into the pin holes 124 to couple the dogs together.

Next, the drill string is lowered by means of the drill string hanging unit 83, and the flange provided at the bottom of the inner housing of the existing drill collar 80 is received and held by the slide frame 106 of the holding means 106.

The drill string is disconnected just above the existing drill collar 80, the upper half of the disconnected drill string is hoisted by the drill string hanging unit 83, thus assuring between the top end of the existing drill collar 80 and the bottom end of the upper half of the disconnected drill string a space necessary for adding a new drill collar.

Similarly to the addition of a new drill pipe, the adjoining jig 126 is moved from the parking position to a position where the addition of a new drill collar is done. An additional drill collar is hoisted nearly perpendicularly by the wire rope 144 from the hanger 143, fitted on the stand pin 134 of the adjoining jig 126 and supported by the adjoining jig 126, and so tilted by the jack unit 136 of the adjoining jig 126 so that the axis of the additional drill collar is aligned with that of the upper half of the drill string. By lowering the upper half of the drill string, the connection at the bottom end of the latter is made to abut and is joined to the top end of the additional drill collar.

Here, the upper half of the drill string to which the additional drill collar has been joined is lowered until said drill collar completely leaves the stand pin 134 of the ajoining jig 126. At this stage, the adjoining jig 126 is returned to the parking position, the upper half of the drill string to which the additional drill collar has been joined is lowered, the drill collar additionally joined to the upper half of the drill string is joined to the existing drill collar, and thereafter, the drill string 70 as a whole is lifted until the flange of the existing drill collar 80 is disconnected from the slide frame 108 of the holding means 106. The set pin 125 coupling the second pair of dogs 122 is extracted from the pin holes to open the dogs 122, thus extending the piston rod 110 by means of the cylinder 109 of the holding means 106 for thereby returning the slide frame 108 of the holding means 106 and its accessory members to the parking position.

The drill string 70 as a whole is lowered and given a turning force and thrust for drilling again in order to further drill the earth.

Thus, a single drill-string holding means 106 and a single adjoining jig 126 can be used to adjoin a drill pipe of a small diameter with a drill collar of a large diameter.

In case the projections from the earth 150 of the steel pipes 151 previously driven vary in length, the installing position of the second frame 63 can be adjusted in the following procedure:

The second frame 63 as a whole is held by an auxiliary hanging unit (not shown) by means of the hanging bracket 69 provided on the top end of the third component member **63*c* of the second frame 63, the set pin 66 coupling the fixing plate 63*d* with the guide rails 51 on the leader 43 is extracted from the pin holes, the position of the entire second frame 63 is adjusted by moving it upward or downward along the leader by means of said auxiliary hanging unit or the like, and thus the second pin holes (not shown) formed in the fixing plate 63*d* on the second frame 63 are made to coincide with any selected ones of the plurality of first pin holes 52 formed in the guide rails 51. Thus, the set pins 66 are inserted into the pin holes from the outside of the leader to fix the second frame 63**.

Figure 24:
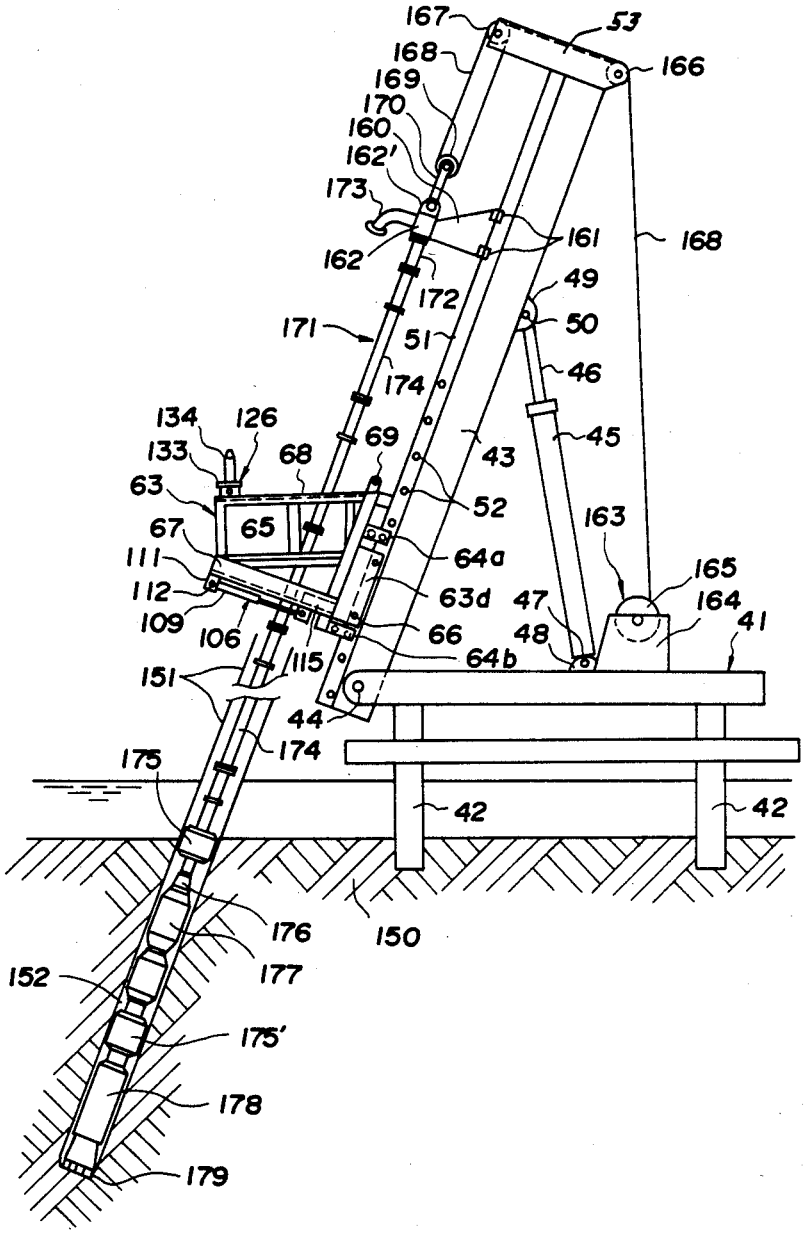
FIG. 24 shows a second embodiment of the present invention applied to an inclined shaft drilling rig in operating position, with portions broken away.

FIG. 24 shows a second embodiment of the present invention, in which a platform 41 has installed at the front end thereof by means of a support pin 44 a leader 43, and provided on the top thereof a winch 165 of hanging unit 163 for first frame and drill string. Said platform is constructed similarly to that of said first embodiment.

Said leader 43 has mounted at the front upper portion thereof a first frame 160 for holding the drill string, and at the front lower portion a second frame 63. Note that the construction of the leader 43 itself and means of supporting the leader 43 are similar to those of said first embodiment.

Said first frame 160 is so mounted on guide rails 51 provided on the front of the leader 43 as to be vertically movable along the guide rails 51 by means of guide members 161. The first frame 160 has provided thereon a fixture 162 for the drill string. The first frame 160 is hoisted and supported by a hanging unit 163.

The hanging unit 163 comprises the winch 165 installed on a winch frame 164 provided on the platform 41, sheaves 166 and 167 mounted on an upper frame 53 fixed to the leader 43, wire rope 168, sheave 169 carried by said wire rope 168, and a link 170 coupling a bracket 162' mounted at the top end of said fixture 162 of the first frame 160 with said sheave 169; said wire rope unwound from the winch 165 is routed over the sheaves 166, 167 and 169 and connected at one end thereof to a fixing member such as said upper frame 53. The hanging unit 163 is so arranged that as the wire rope 168 is wound or unwound by the winch 165, the first frame 160 and a drill string 171 fixed to said first frame 168 are raised or lowered. During drilling the earth, the hanging unit 163 supports the drill string 171 in place by means of said first frame 160.

Said second frame 63 has provided on the top of first component member 63*a* thereof guide rails 68 for supporting a receiving means for a new drill string component. Said guide rails 68 have mounted thereon an adjoining jig 126 for receiving a new drill string component to be added. There are provided a scaffold 65 below the first component member and the second component member 63*b* has installed thereon guide rails 67 for the holding means for the lower half of disconnected drill string, cylinder 109 comprising said holding means 106, etc. The third component member 63*c* has provided thereon guide units 64*a* and 64*b* of the second frame 63, fixing plate 63*d* with pin holes formed therein, hanging bracket 69, etc. It should be noted that the linkage of said guide units 64*a* and 64*b*, scaffold 65, guide rails 67 and 68, leader 43 and second frame 63 are similar to that in the first embodiment having been described.

Said drill string 171 is composed, from the top, as coupled to one another, of a drill string head 172 with an elbow 173, drill pipe 174 connected to said head 172, upper and lower stabilizers 175 and 175' for drill string guide, joint pipe 176 which couples upper and lower members which are different in diameter between the top and bottom thereof, drill collar 177, means for imparting turning force and thrust for drilling and a drill bit 179. Said means 178 for giving a turning force and thrust for drilling incorporates a rotary drive unit (not shown) which provides a turning force for drilling, and a jack (not shown) to provide a thrust, and it is so arranged as to provide only the drill bit with the turning force and thrust for drilling. Said drill collar 177 is provided to accomodate the reaction of the jack which provides the thrust, in the means of giving a turning force and thrust for drilling. In case a gripper protruding inwardly of the drilled shaft is provided outside of the means of providing the turning force and thrust for drilling, the drill collar 177 may be omitted. Said drill string 171 is fixed to the fixture 162 provided on said first frame 160 by means of the drill string head 172, and also it is supported on said hanging unit 163 by means of the first frame 160. With this drill string 171, an inclined shaft 152 is drilled by the drill bit 179 inside the steel pipe 151 previously driven into the earth 150, slush is sucked up through the inside of the drill string 171 and discharged from the bend 173. After drilling the earth for nearly a length of a drill pipe 174, the drill string 171 is disconnected at a point in the axial direction thereof and a new drill pipe 174 is added to the drill string for further drilling the earth 150.

In the second embodiment of inclined shaft drilling rig, the drill string 171 is supported by means of the first frame 160 and suspended from the hanging unit 163.

The turning force and thrust for drilling are imparted to only the drill bit 179 from the means 178 of giving the turning force and thrust for drilling. An inclined shaft 152 is drilled by the drill bit 179 thus driven, inside the steel pipe 151 previously driven into the earth 150. The slush is sucked up through the drill string 171 and discharged outside through the elbow 173 provided on the drill string head 172.

After having drilled the earth 150 to a depth nearly equivalent to the length of a drill pipe 174, the means 178 for giving the turning force and thrust for drilling is stopped, the jack of the means 178 is extended, the drill bit 179 is raised, and the drill string 171 as a whole is lowered by the hanging unit 163 until the drill bit 179 reaches the bottom of the drill hole (inclined shaft). Then, the means 106 for holding the lower half of the drill string is moved from the parking position to a position where a new drill pipe is added to the drill string. The flange provided nearly in the middle in the axial direction of the drill pipe 174 is utilized to hold the drill string 171 by means of the holding means 106. The drill string 171 is disconnected at a point in the axial direction thereof, and the first frame 160 and the upper half of the drill string are raised by means of the hanging unit 163, thereby defining between the lower and upper halves of the drill string a space necessary for adding a drill pipe 174 to the drill string.

Then, the jig 126 for adjoining a new drill string component is moved from the parking position to a position where the drill pipe is to be added to the drill string. At this adjoining position, the additional drill pipe (not shown) having been hoisted by the hanger (not shown) is fitted at the inside diameter thereof on the stand pin 134, at the outside diameter, of the adjoining jig 126, and the bottom end of the additional drill pipe is received and supported by the receiving seat 133 of the adjoining jig 126. The receiving seat 133 of the adjoining jig 126 and the stand pin 124 are tilted so that the connection at the top end of the additional drill pipe is made to coincide with the connection at the bottom end of the upper half of the drill string. Then, the connections are coupled by bolts or the like. After having coupled the connections, the drill string as a whole is raised by means of the changing unit 163 unit new additional drill pipe is completely off the stand pin 134.

Then the adjoining jig 126 is moved to the parking position, the upper half of the drill string to which the addtional drill pipe has been joined is lowered until the connection at the bottom end of the upper half of drill string abuts the connection at the top end of the lower half of the drill string, the connections are joined by bolts or the like, the means 106 for holding the lower half of the drill string is released and moved to the parking position, and the means 178 for giving the turning force and thrust for drilling is driven again to resume drilling the earth.

Also in case of adding a drill collar 177 to accommodate a reaction to the thrust of the drill string 171, the drill collar can be added to the drill string in the same procedure as above. Note that in this second embodiment, same elements as in the first embodiment are shown with same reference numerals.

Figure 25:
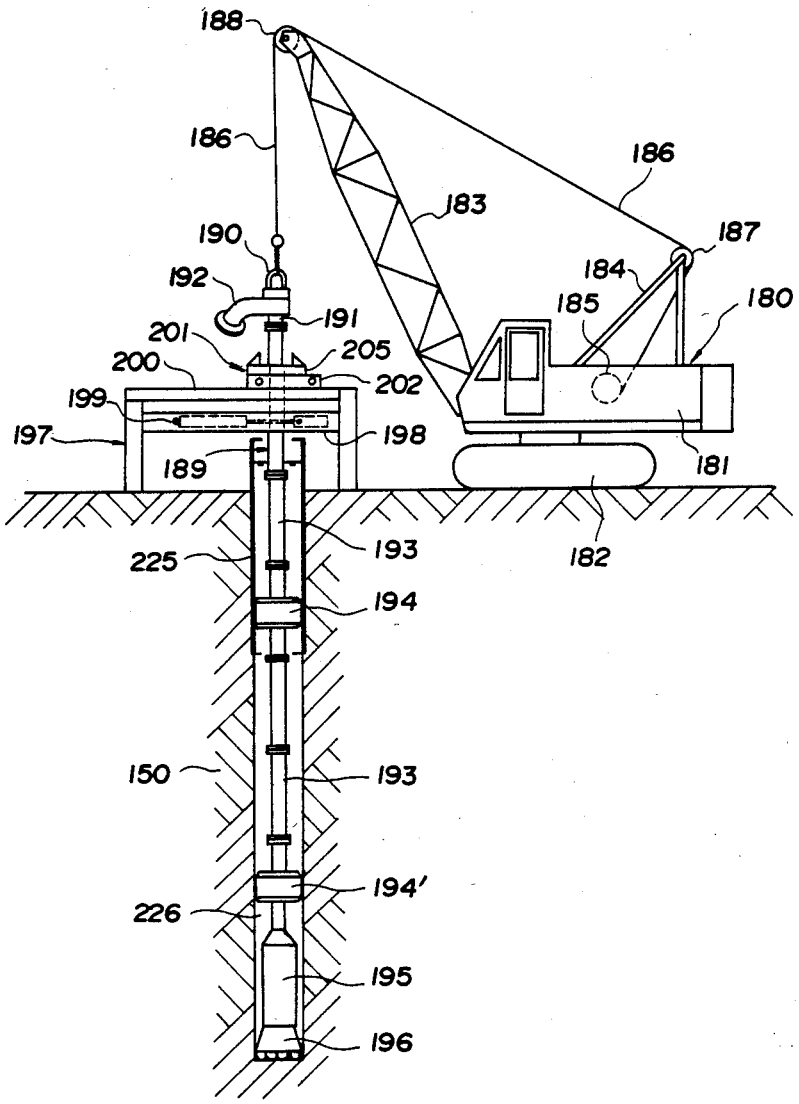

FIG. 25 shows a third embodiment according to the present invention, an example of a shaft drilling rig for drilling a vertical shaft. FIGS. 26 to 30 show together an example of an adjoining jig for supporting a new drill string component to be added to the drill string in the third embodiment.

The shaft drilling rig shown in FIG. 25 is composed of a crawler crane 180 for supporting the drill string, drill string 189 suspended from the crane, frame 197 fixed to the earth 150, adjoining jig 201 provided on said frame 197, and a means 199 for holding the drill string.

Said crawler crane 180 is composed of a crane body 181, crawler 182, jib 183 installed at the front end of the crane body 181, A frame 184 and winch 185 installed on the crane body 181, and a wire rope 186 for suspending the drill string. Said wire rope 186 is unwound from the winch 185, routed over a sheave 187 provided on the A frame 184 and another sheave 188 provided atop the jib 183, and connected to the connector 190 fixed to the top of the drill string 189. In this crawler crane 180, as the wire rope 186 is wound or unwound by the winch 185, the drill string 189 is raised or lowered. During drilling the earth, the drill string 189 is supported vertically in place.

Said drill string 189 is composed, from the top, of the connector 190 for the wire rope 186, drill string head 190 with a bend 192, drill pipe 193 connected to the drill string head 191, upper and lower stabilizers 194 and 194' for the drill string guide, drill pipe 193 between said stabilizers 194 and 194', means 195 for providing a turning force and thrust for drilling, and a drill bit 196, coupled to one another. The drill string 189 is connected to the wire rope 186 by means of the connector 190, and supported by said crawler crane 180. The means 195 for giving the turning force and thrust for drilling is so arranged as to give the turning force and thrust to the drill bit 196 alone. With this drill string 189, a vertical shaft 226 is drilled by the drill bit 196 inside the steel pipe 225 previously driven by a pile driver or the like in the earth 150. The slush is sucked up through the drill string 189 and discharged outside through the elbow 192. After having drilled the earth 150 to a depth nearly equivalent to the length of a drill pipe 193, the drill string 189 is disconnected at a point in the axial direction thereof, and a new drill pipe is added to the drill string for further drilling.

Figure 29:
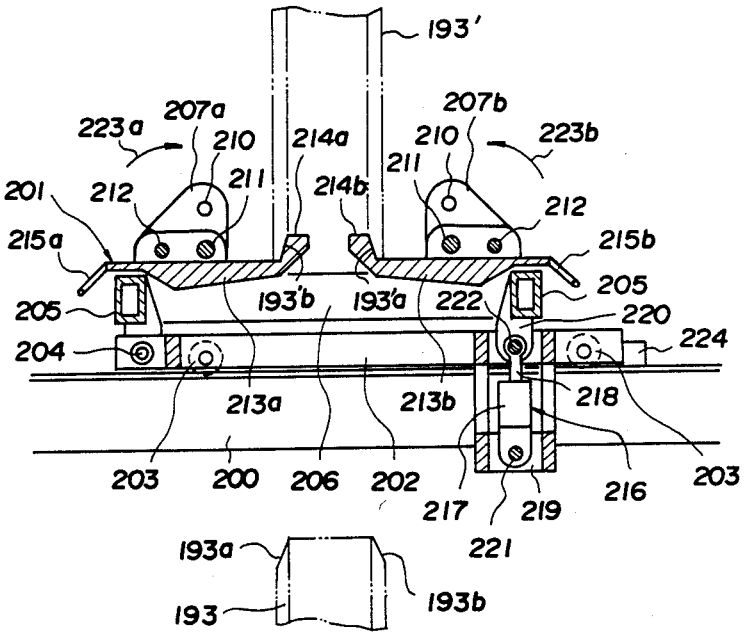
Figure 30:
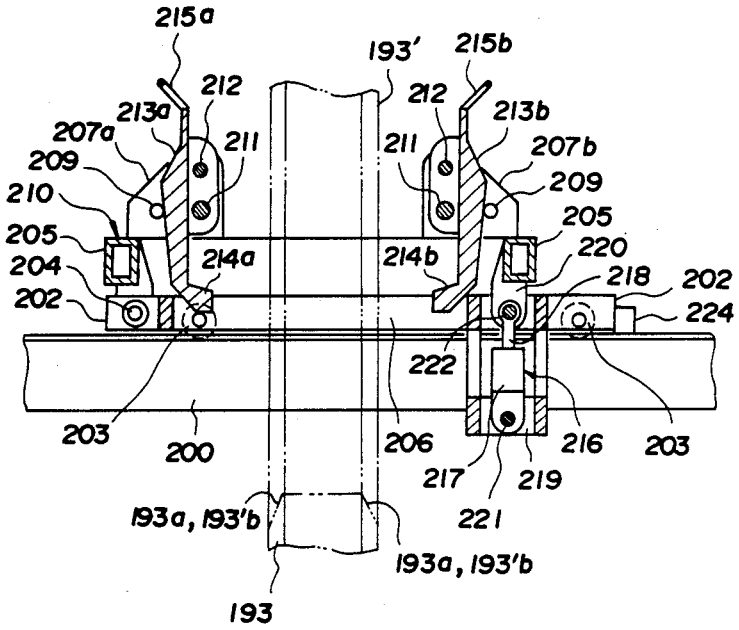

It should be noted that said drill pipe 193 has formed outside the top end thereof a tapered surface **193*a* which is externally threaded, and inside the bottom end thereof another tapered surface which engages with said tapered surface 193*a* and also is threaded for reception of said external thread. In FIGS. 29 and 30, however, the tapered surface at the bottom end is shown with a reference 193'*b* for a new drill pipe 193** to be added.

Said frame 197 is placed in position on the earth 150, and provided at the middle stage thereof with a means 199 for holding the drill string 189 temporarily. Further, the frame 197 has installed on the top thereof two parallel guide rails 200 on which an adjoining jig 201 for supporting a new drill pipe (not shown) to be added to the drill string.

Said means 199 for holding the drill string 189 is installed on a beam 198 fixed to the frame 197. A slide frame and its accessory members, comprising the holding means 199, are so supported as to be movable along guide rails (not shown) mounted on the beam 198 and between the parking position and a position where the additional drill pipe is to be joined to the drill string. The remaining construction of this holding means 119 is similar to that of the holding means 106 which has been explained with reference to said first embodiment of the present invention.

Said adjoining jig 201 is composed, as shown in FIGS. 26 to 29, of a lower frame 202, upper frame 205 pivoted tiltably at one end by means of support pins 204 on said lower frame 202 and provided with brackets **207*a* and 207*b* for receiving a drill pipe or the like, a pair of two receivers 213*a* and 213*b* supported on said brackets 207*a* and 207*b* by means of first and second pins 211 and 212, and a jack 216** for tilting the upper frame.

Said lower frame 202 is so arranged as to be movable and guided by the rollers 203 along the guide rail 200 provided on said frame 197 to the parking and adjoining positions.

Figure 27:
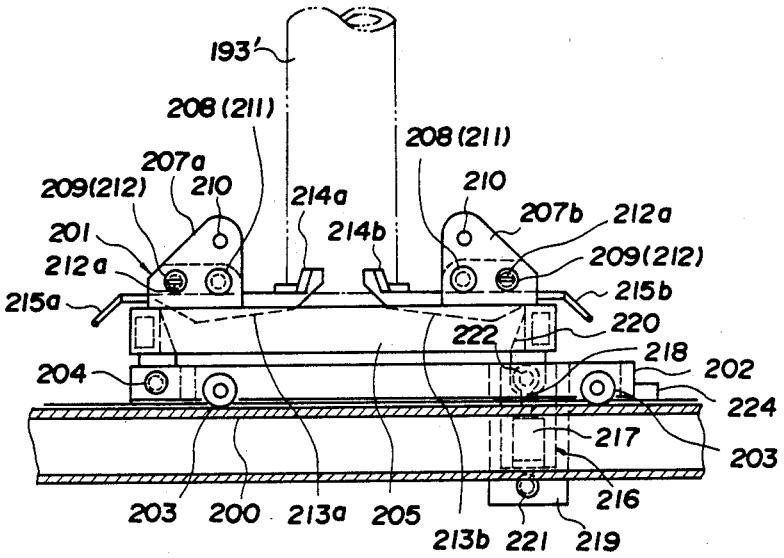
Figure 28:
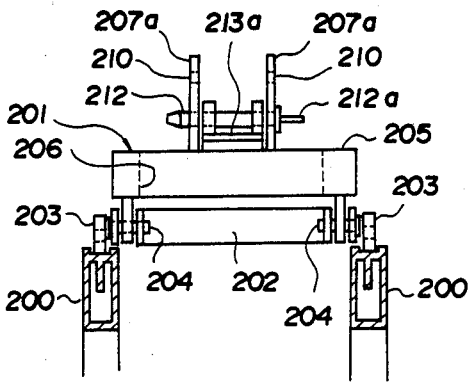

Said upper frame 205 has formed in the center thereof a hole 206 through which a drill pipe 193, a new drill string component, can be vertically lowered when the receivers **213*a* and 213*b* are pivoted from the horizontal to vertical position. The brackets 207*a* and 207*b* for said receivers are installed on opposite sides of said hole 206 formed in the upper frame 205, and each of the brackets 207*a* and 207*b* is provided, as shown in FIG. 27, with three pin holes 208, 209 and 210. The first and second ones 208 and 209 of these three pin holes are provided and horizontally spaced from each other, and the third pin hole 210 is formed above the first pin hole 208 and has the same size as the second pin hole 209**.

Figure 26:
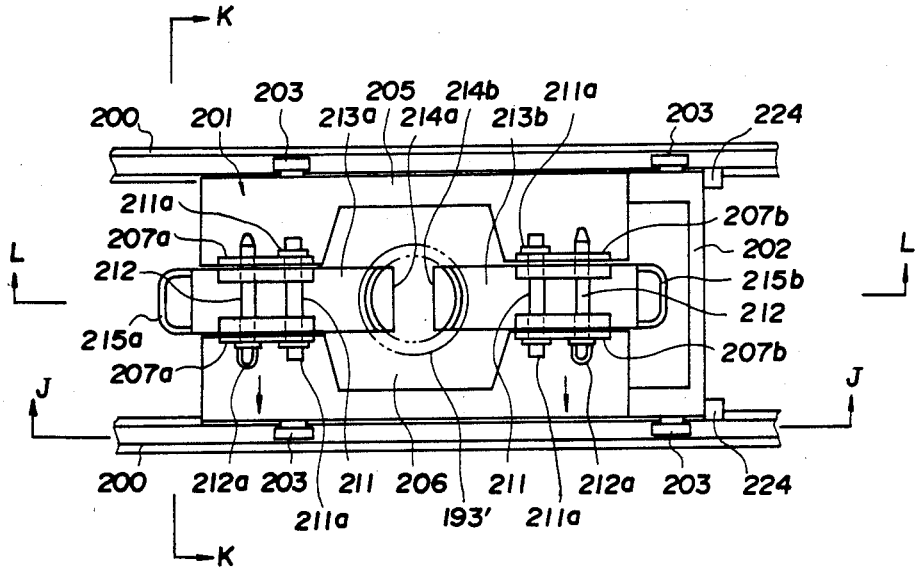

Said receivers **213*a* and 213*b* have formed at the tops of the inner ends thereof receiving protrusions 214*a* and 214*b*, and at the other ends thereof handles 215*a* and 215*b*. Said receiving protrusions 214*a* and 214*b* are so shaped as to receive and support an additional drill pipe 193' at the inner tapered surface 193'*b* at the bottom end thereof. The receivers 213*a* and 213*b* are horizontally supported with said first and second pins 211 and 212 inserted in the first and second pin holes 208 and 209 as shown in FIGS. 26 and 27, while they are pivoted in the directions of arrows 223*a* and 223*b* in FIG. 29 with the second pin 212 extracted from the second pin hole 209. By inserting into the third pin hole 210 the second pin 212 having been extracted, the receivers 213*a* and 213*b* are nearly vertically supported as shown in FIG. 30. Further, the receivers 213*a* and 213*b*, in the position as vertically supported, will receive the additional drill string component at the bottom end thereof, and at the bore thereof by the receiving protrusions 214*a* and 214*b*. Thus, any drill string components of different diameters from one to another can be stably supported. When the receivers 213*a* and 213*b* are pivoted about said first pin 211, an additional drill string component is lowered toward the connection at the top end of the drill string. With the drill string supported in said vertical position, drilling can be done without moving the adjoining jig 201** from the parking position.

Said first pins 211 are secured to the brackets **207*a* and 207*b* by means of snap rings 211*a* fitted at opposite ends, and the second pins 212 can be extracted or inserted by gripping the handles 212*a***.

Said jack 216 is, as shown in FIGS. 27 and 29, provided at the end of the lower frame 202 opposite to the support pin 204. The jack 216 is provided with a cylinder 217 and a piston rod 218 inserted in the cylinder 217. The cylinder 217 is connected to a bracket 219 fixed to the lower frame 202 by means of a pin 221. On the other hand, the piston rod 218 is connected by means of a pin 221 to a bracket 220 installed to the upper frame 205. Said jack 216 tilts the upper frame 205 about the support pin 204 by extending the piston rod 218 by the cylinder 217, thereby aligning the axis of a new drill string component supported by the receivers **213*a* and 213*b* with that of the existing drill string. By contracting the piston rod 218, the upper frame 205** can be supported in the horizontal position as shown.

Furthermore, said guide rails 200 have provided thereon stoppers 224 for adjoining jig 201. With the adjoining jig 201 at the splicing position, the center of the hole 206 in the upper frame 205, the center between the receiving protrusions **214*a* and 214*b* when the receivers 213*a* and 213*b*** are supported in horizontal position, and the center of the existing drill string can be aligned with one another.

The shaft drilling rig according to the third embodiment of the present invention will operate as follows:

With the drill string 189 supported in place in the vertical direction by means of the wire rope 186 unwound from the winch 185 installed on the crawler crane 180 and routed over the sheaves 187 and 188, the means 195 for giving a turning force and thrust for drilling imparts a turning force and thrust for drilling to the drill bit 196 which in turn will drill a vertical shaft 226 inside the steel pipe 225 driven previously in the earth 150 by a pile driver or the like, and the slush is sucked up through the drill string 189 and discharged outside from the elbow 192.

After having drilled the earth 150 to a depth nearly equivalent to the length of a drill pipe 193, the means 195 for imparting a turning force and thrust for drilling is stopped and the jack of the means 195 is extended to raise the drill bit 196. Then, the wire rope 186 is unwound from the winch 185 to lower the entire drill string 189 until the drill bit 196 reaches the bottom of the drill hole (vertical shaft). Then, the slide frame and receiving seat of the drill string holding means 199 are moved from the parking position to the adjoining position where they are held at the flange (not shown) provided nearly at the middle in the axial direction of the drill pipe 193 by means of the holding means 199.

The drill string 189 is disconnected at the connection between the drill string head 191 and the drill pipe 193 just below the head 191, or at the connection between the drill pipes 193. The drill string head 191 is hoisted by the wire rope 186, thereby defining between the drill string head 191 and the disconnected drill string a space necessary for adding a new drill pipe.

The additional drill pipe is suspended by the hanger (not shown), moved to above the receivers 213*a* and 213*b* of the adjoining jig 201 waiting at the parking position, and lowered toward the receiving protrusions 214*a* and 214*b* provided on the receivers 213*a* and 213*b*. As the result, a additional drill pipe 193' is so positioned, as shown by imaginary line in FIGS. 26, 27 and 29, as to be aligned with the center of the hole 206 formed in the upper frame 205 by means of the engagement between the bore of the additional drill pipe and receiving protrusions 214*a* and 214*b*, and the additional drill pipe 193' is supported at the bottom end thereof on the receivers 213*a* and 213*b*.

The adjoining jig 201 supporting the additional drill pipe 193' is moved, as shown in FIGS. 27 and 29, from the parking position to the adjoining position where it abuts the stoppers 224. Then, the disconnected string head 191 is lowered and the internal thread at the bottom end thereof is engaged with the external thread at the upper end of the drill string just below the head. In this splicing position, when the second pins 212 inserted in the second pin holes 209 of the brackets 207*a* and 207*b* are extracted, respectively, the receivers 213*a* and 213*b* are pivoted in the directions of arrows 223*a* and 223*b* shown in FIG. 29, the additional drill pipe 193' is disengaged from the receiving protrusions 214*a* and 214*b* as shown in FIG. 30. Then the drill pipe 193' is lowered toward the upper end of the lower half of the disconnected drill string, so that the tapered surface 193'*b* as the connection at the bottom end of the additional drill pipe 193' comes into engagement with the tapered surface 192*a* of the connection at the top end of the drill string.

The external thread of the connection at the top end of the drill string is engaged and connected with the internal thread of the tapered surface 193'*b* at the bottom end of the additional drill pipe 193'.

After having joined the drill pipe 193' to the drill string, the second pins 212 having been extracted and inserted into the third pin holes 210, respectively, to fix the receivers 213*a* and 213*b* in vertical position.

Then, the drill string holding means 199 is released, and the means 195 for giving a turning force and thrust for drilling is driven again, thereby drilling the earth.

After having drilled the earth to a depth equivalent to the length of a drill pipe, by inserting the second pins 212 into the third pin holes 210, the second pins 212 are extracted from the third pin holes 210 when the drill string is disconnected at a point in the axial direction next, and the receiving protrusions 214*a* and 214*b* are held in horizontal position and moved to the parking position.

When the adjoining jig 201 is used with a shaft drilling rig for inclined shaft, the jack 216 is actuated when the jig 201 is in the adjoining position during adding a new drill string component, the upper frame 205 is tilted about the support pin 204 to tilt the connection of the additional drill string component supported by the receivers 213*a* and 213*b* so as to coincide with the connection of the drill string supported as inclined. Thus, the adjoining can be easily done.

The third embodiment according to the present invention uses a crawler crane 180 as the means for supporting the entire drill string. However, a stationary crane or a tower may be used for this purpose.

Furthermore, the receiving protrusions 214*a* and 214*b* provided on the receivers 213*a* and 213*b* in the adjoining jig 201 can be used to position and securely support tubular drill string components of a same inside diameter and having different outside shapes.

ADVANTAGEOUS EFFECT OF THE INVENTION

The shaft drilling rig comprises a means for receiving an additional drill string component at least at the bottom end thereof, means for supporting said receiving means so as to be stably movable between the adjoining and parking positions, and a means for holding the drill string. The additional drill string component can be held by said holding means to join the component to the drill string. Thus, possible dangers involved in the prior-art adjoining technique such as supporting and positioning, for adjoining, by the workers of the drill string component suspended in the air can be eliminated. Therefore, the work of adjoining a drill string component can be done very safely, and in addition, the additional drill string component can be joined to the drill string positively and in a reduced time.

Since said receiving means according to the present invention is composed of a seat for receiving a new drill string component at the bottom end thereof, and a stand pin provided on said receiving seat and which can guide the drill string component along the bore, any drill string components different in outside shape from one to another can be securely received by utilizing the fact that tubular ones of additional drill string components are so formed as to have the same inside diameter.

Further, said receiving means according to the present invention is composed of a plurality of receivers disposed and spaced in the circumferential direction in the same plane. Each of the receivers has provided at the inner end thereof a receiving protrusion which can position and support an additional drill string component, and it further comprises a means of selective switching between a position in which the additional drill string component can be supported and a position in which said supported additional drill string component can be lowered. Thus, said additional drill string component can be rapidly abutted to the connection at the top end of the drill string.

Said receiving means of the present invention is provided with a tilting means which aligns the connection of an additional drill string component with that of the drill string. Because of this tilting means, it is possible, especially in case of an inclined shaft drilling rig, to easily align the connection of said additional drill string component with that of the disconnected drill string. Thus, the connections can be positioned more easily with respect to each other.

The shaft drilling rig according to the present invention comprises a first and second frames installed on upper and lower halves of a leader at the front thereof, guide rails provided at the upper portion of said second frame and which support a receiving means so as to be stably movable between the adjoining and parking positions, receiving means mounted on said guide rails and which receives a new drill string component at least at the bottom end thereof, holding means coupled with said first frame and which holds the disconnected drill string at the upper half thereof, and another holding means provided at the lower portion of said second frame and which holds the disconnected drill string at the lower half thereof. Thus, the necessary members of a drill string are disposed reasonably on the first and second frames so that the functions of the frames are shared by these frames. The frames as a whole can be designed compact and lightweight.

According to the present invention, said second frame can be moved vertically along the leader for adjusting the position of the second frame, and any selected ones of a plurality of pin holes formed in the leader are made to coincide with the pin holes provided in the second frame. Thus, the leader and second frame are connected by inserting set pins into the pin holes thus superposed. When it is necessary to adjust the position of the second frame because the projecting portions of the steel pipes previously driven in the earth by a pile driver or the like vary in length, the second frame comprising said receiving means and the means for holding the drill string at the lower half thereof can be moved along the leader to an appropriate position, and easily fixed in the adjusted position.

Furthermore, according to the present invention, one drill string guide unit is provided each at the upper and lower portions of said first frame, and these two guide units are located with a relatively long space between them so that the drill string can be supported on these guide units. Therefore, especially in case of an inclined shaft drilling rig, when a new drill string component is to be added to the drill string, possible tilt of the upper half of the disconnected drill string due to its own weight can be considerably minimized.

Since according to the present invention, guide rails for supporting said receiving means are provided on said second frame, a scaffold is provided below the guide rails, and further such an arrangement is made that when adding a new drill string component, the connection at the top end of the lower half of the drill string is positioned between said guide rails and scaffold, adjoining between the connection at the top end of the lower half of the drill string and that at the bottom end of the drill string component having been added to the upper half of the drill string, can be effectively done by the workers standing at ease.

Besides, according to the present invention, said means for holding the drill string is so arranged as to be applicable both to drill string components which have a small outside diameter and those which have a large outside diameter. Namely, the single holding means can effectively be utilized for holding drill string components of different outside shapes.

What is claimed is:

1. A shaft drilling rig comprising:

a supporting structure for a drill string having a plurality of components for drilling a shaft into the earth by imparting a turning and thrust for drilling at least to a drill bit on the drill string, the drilling being down to a predetermined depth, and then a further drill string component having at least at the bottom end thereof an inner wall extending substantially in the axial direction of the component being newly added to the drill string for further drilling;

means for receiving at least the bottom end of the further drill string component and for supporting it, and having a member with the outer circumference engageable with the inner wall of the further component, said receiving means supporting the further drill string component in a free standing position;

means for supporting said receiving means and having a guiding device for guiding said receiving means between a position where the further drill string component is to be added to the drill string and a parking position spaced laterally of the drill string from said first mentioned position; and means for holding a lower part of the drill string which has been separated from the upper part of the drill string preparatory to adding the further drill string component so that the axis of said lower part is substantially aligned with the drilling direction.

2. A shaft drilling rig as claimed in claim 1 in which said receiving means comprises:

a seat for receiving the bottom end of the further drill string component; and a standing pin on said receiving seat over which the inner wall of the further drill string component is adapted to be guided and closely fitted for guiding the further drill string component onto said seat and holding it upright on said seat.

3. A shaft drilling rig comprising:

a base structure;

a supporting structure mounted on said base structure for supporting a drill string for drilling a shaft to a predetermined depth into the earth by imparting a turning force and thrust for drilling to at least a drill bit of the drill string and for permitting the drill string to be disconnected for allowing the addition to the drill string of a further drill string component having at least at the bottom end thereof an inner wall extending substantially in an axial direction;

a first frame mounted on the upper half of the front of said supporting structure;

a second frame mounted on the lower half of the front of said supporting structure;

means for receiving at least the bottom end of the further drill string component and supporting it in a free standing position;

guide rails mounted on said second frame and on which said receiving means is movably mounted for guiding said receiving means between a position where the further drill string component is to be joined to the drill string and a parking position spaced laterally of the drill string from said firstmentioned position;

a first holding means on said first frame for holding the upper portion of the drill string which has been disconnected from the lower portion of the drill string with the axis of the upper portion substantially aligned with the drilling direction; and a second holding means on said second frame for holding the lower portion of the drill string which has been disconnected from the upper portion of the drill string with the axis of the lower portion substantially aligned with the drilling direction.

4. A shaft drilling rig as claimed in claim 3 in which said second frame and said supporting structure include means for adjustably positioning said second frame along said supporting structure, said means comprising a part of said supporting structure having a plurality of holes therein and a part of said second frame having holes therein alignable with the holes in said supporting structure, and set pins which are insertable into the aligned holes for fixing said second frame on supporting structure.

5. A shaft drilling rig as claimed in claim 3 in which said first frame has at least at the top and bottom portions thereof a guiding unit for guiding the drill string in the direction of drilling.

6. A shaft drilling rig as claimed in claim 3 wherein said guide rails are at the top of said second frame and said rig further comprises a platform mounted on said second frame below said guide rails, and said firstmentioned position is between said platform and said guide rails.

7. A shaft drilling rig as claimed in claim 3 wherein said second holding means comprises means for holding further drill string components having both small and large outside diameters.

8. A shaft drilling rig comprising:

a supporting structure for a drill string having a plurality of components for drilling an inclined shaft into the earth by imparting a turning and thrust for drilling at least to a drill bit on the drill string, the drilling being down to a predetermined depth, and then a further drill string component having at least at the bottom end thereof an inner wall extending substantially in the axial direction of the component being newly added to the drill string for further drilling;

inclining means connected with said supporting structure for inclining said supporting structure to the angle of the inclined shaft;

means for receiving the further drill string component and for supporting it in a free standing position;

means connected to said receiving means for tilting said receiving means for aligning a further drill string component supported thereon with the tilted drill string;

means for supporting said receiving means and having a guiding device for guiding said receiving means between a position where the further drill string component is to be added to the drill string and a parking position spaced laterally of the drill string from said firstmentioned position; and means for holding a lower part of the drill string which has been separated from the upper part of the drill string preparatory to adding the further drill string component so that the axis of said lower part is substantially aligned with the drilling direction.

9. A shaft drilling rig as claimed in claim 8 wherein said receiving means comprises means for receiving at least the bottom end of the further drill string component and for supporting it and a member having the outer circumference engageable with the inner wall of the further component, said receiving means supporting the further drill string component in a free standing position.

10. A shaft drilling rig as claimed in claim 8 wherein said inclining means comprises a leader pivotally mounted on said supporting structure and a piston cylinder device connected to said leader for inclining said leader.

11. A shaft drilling rig as claimed in claim 10 wherein said supporting structure comprises a first frame mounted on the upper half of the front of said leader, further holding means on said first frame for holding the upper portion of the drill string which has been disconnected from the lower portion of the drill string with the axis of the upper portion substantially aligned with the drilling direction, and said means for supporting said receiving means comprises a second frame mounted on the lower half of the front of said leader.

12. A shaft drilling rig as claimed in claim 11 in which said second frame and said leader include means for adjustably positioning said second frame along said leader, said means comprising a part of said leader having a plurality of holes therein and a part of said second frame having holes therein alignable with the holes in said leader, and set pins which are insertable into the aligned holes for fixing said second frame on said leader.

13. A shaft drilling rig as claimed in claim 11 in which said first frame has at least at the top and bottom portions thereof a guiding unit for guiding the drill string in the direction of drilling.

14. A shaft drilling rig as claimed in claim 11 wherein said guide rails are at the top of said second frame and said rig further comprises a platform mounted on said second frame below said guide rails, and said firstmentioned position is between said platform and said guide rails.

15. A shaft defining rig as claimed in claim 11 wherein said second means for holding the lower portion of the drill string comprises means for holding further drill string components having both small and large outside diameters.

* * * * *